US007086839B2

(12) United States Patent
Kenny et al.

(10) Patent No.: US 7,086,839 B2
(45) Date of Patent: Aug. 8, 2006

(54) MICRO-FABRICATED ELECTROKINETIC PUMP WITH ON-FRIT ELECTRODE

(75) Inventors: Thomas W. Kenny, San Carlos, CA (US); James Gill Shook, Santa Cruz, CA (US); Shulin Zeng, Sunnyvale, CA (US); Daniel J. Lenehan, Los Altos Hills, CA (US); Juan Santiago, Fremont, CA (US); James Lovette, Palo Alto, CA (US)

(73) Assignee: Cooligy, Inc., Mountain View, CA (US)

( * ) Notice: Subject to any disclaimer, the term of this patent is extended or adjusted under 35 U.S.C. 154(b) by 153 days.

(21) Appl. No.: 10/669,495

(22) Filed: Sep. 23, 2003

(65) Prior Publication Data

US 2004/0101421 A1 May 27, 2004

Related U.S. Application Data

(63) Continuation-in-part of application No. 10/366,121, filed on Feb. 12, 2003, now Pat. No. 6,881,039.

(60) Provisional application No. 60/413,194, filed on Sep. 23, 2002, provisional application No. 60/442,383, filed on Jan. 24, 2003.

(51) Int. Cl.
*F04F 11/00* (2006.01)

(52) U.S. Cl. ..... 417/48; 204/600

(58) Field of Classification Search ..... 417/48, 417/50; 204/600, 601

See application file for complete search history.

(56) References Cited

U.S. PATENT DOCUMENTS

| | | | | |
|---|---|---|---|---|
| 596,062 | A | 12/1897 | Firey | |
| 2,039,593 | A | 5/1936 | Hubbuch et al. | |
| 2,273,505 | A | 2/1942 | Florian | |
| 3,267,859 | A | 8/1966 | Jutila | 103/1 |
| 3,361,195 | A | 1/1968 | Meyerhoff et al. | |
| 3,554,669 | A | 1/1971 | Reader | 417/48 |
| 3,654,988 | A | 4/1972 | Clayton, III | |

(Continued)

FOREIGN PATENT DOCUMENTS

| | | |
|---|---|---|
| CN | 97212126.9 | 3/1997 |

(Continued)

OTHER PUBLICATIONS

Stephen C. Jacobson et al., "Fused Quartz Substrates for Microchip Electrophoresis", Analytical Chemistry, Vo. 67, No. 13, Jul.1, 1995, pp. 2059-2063.

(Continued)

*Primary Examiner*—Michael Koczo, Jr.
(74) *Attorney, Agent, or Firm*—Haverstock & Owens LLP

(57) ABSTRACT

An electroosmotic pump and method of manufacturing thereof. The pump having a porous structure adapted to pump fluid therethrough, the porous structure comprising a first side and a second side, the porous structure having a plurality of fluid channels therethrough, the first side having a first continuous layer of electrically conductive porous material deposited thereon and the second side having a second continuous layer of electrically conductive porous material deposited thereon, the first second layers coupled to a power source, wherein the power source supplies a voltage differential between the first layer and the second layer to drive fluid through the porous structure at a desired flow rate. The continuous layer of electrically conductive porous material is preferably a thin film electrode, although a multi-layered electrode, screen mesh electrode and beaded electrode are alternatively contemplated. The thickness of the continuous layer is in range between and including 200 Angstroms and 10,000 Angstroms.

49 Claims, 10 Drawing Sheets

U.S. PATENT DOCUMENTS

| | | | | |
|---|---|---|---|---|
| 3,771,219 | A | 11/1973 | Tuzi et al. | |
| 3,817,321 | A | 6/1974 | von Cube et al. | |
| 3,823,572 | A | 7/1974 | Cochran, Jr. | |
| 3,923,426 | A | 12/1975 | Theeuwes | |
| 3,929,154 | A | 12/1975 | Goodwin | |
| 3,948,316 | A | 4/1976 | Souriau | |
| 4,109,707 | A | 8/1978 | Wilson et al. | |
| 4,138,996 | A | 2/1979 | Cartland | |
| 4,194,559 | A | 3/1980 | Eastman | |
| 4,211,208 | A | 7/1980 | Lindner | |
| 4,248,295 | A | 2/1981 | Ernst et al. | |
| 4,312,012 | A | 1/1982 | Frieser et al. | |
| 4,450,472 | A | 5/1984 | Tuckerman et al. | |
| 4,485,429 | A | 11/1984 | Mittal | |
| 4,516,632 | A | 5/1985 | Swift et al. | |
| 4,540,115 | A | 9/1985 | Hawrylo | |
| 4,561,040 | A | 12/1985 | Eastman et al. | |
| 4,567,505 | A | 1/1986 | Pease et al. | |
| 4,573,067 | A | 2/1986 | Tuckerman et al. | |
| 4,574,876 | A | 3/1986 | Aid | |
| 4,644,385 | A | 2/1987 | Nakanishi et al. | |
| 4,664,181 | A | 5/1987 | Sumberg | |
| 4,758,926 | A | 7/1988 | Herrell et al. | |
| 4,866,570 | A | 9/1989 | Porter | |
| 4,868,712 | A | 9/1989 | Woodman | |
| 4,893,174 | A | 1/1990 | Yamada et al. | |
| 4,894,709 | A | 1/1990 | Phillips et al. | |
| 4,896,719 | A | 1/1990 | O'Neill et al. | |
| 4,908,112 | A | 3/1990 | Pace | |
| 4,938,280 | A | 7/1990 | Clark | |
| 5,009,760 | A | 4/1991 | Zare et al. | |
| 5,016,138 | A | 5/1991 | Woodman | |
| 5,043,797 | A | 8/1991 | Lopes | |
| 5,057,908 | A | 10/1991 | Weber | |
| 5,058,627 | A | 10/1991 | Brannen | |
| 5,070,040 | A | 12/1991 | Pankove | |
| 5,083,194 | A | 1/1992 | Bartilson | |
| 5,088,005 | A | 2/1992 | Ciaccio | |
| 5,096,388 | A | 3/1992 | Weinberg | |
| 5,099,311 | A | 3/1992 | Bonde et al. | |
| 5,099,910 | A | 3/1992 | Walpole et al. | |
| 5,125,451 | A | 6/1992 | Matthews | |
| 5,131,233 | A | 7/1992 | Cray et al. | |
| 5,161,089 | A | 11/1992 | Chu et al. | |
| 5,179,500 | A | 1/1993 | Koubek et al. | 361/385 |
| 5,203,401 | A | 4/1993 | Hamburgen et al. | |
| 5,218,515 | A | 6/1993 | Bernhardt | |
| 5,219,278 | A | 6/1993 | Van Lintel | |
| 5,228,502 | A | 7/1993 | Chu et al. | |
| 5,232,047 | A | 8/1993 | Matthews | |
| 5,239,200 | A | 8/1993 | Messina et al. | |
| 5,239,443 | A | 8/1993 | Fahey et al. | |
| 5,263,251 | A | 11/1993 | Matthews | |
| 5,265,670 | A | 11/1993 | Zingher | |
| 5,274,920 | A | 1/1994 | Mathews | |
| 5,308,429 | A | 5/1994 | Bradley | |
| 5,309,319 | A | 5/1994 | Messina | |
| 5,316,077 | A | 5/1994 | Reichard | |
| 5,317,805 | A | 6/1994 | Hoopman et al. | |
| 5,325,265 | A | 6/1994 | Turlik et al. | |
| 5,336,062 | A | 8/1994 | Richter | |
| 5,371,529 | A | 12/1994 | Eguchi et al. | 347/7 |
| 5,380,956 | A | 1/1995 | Loo et al. | |
| 5,383,340 | A | 1/1995 | Larson et al. | |
| 5,386,143 | A | 1/1995 | Fitch | |
| 5,421,943 | A | 6/1995 | Tam et al. | |
| 5,427,174 | A | 6/1995 | Lomolino, Sr. et al. | |
| 5,436,793 | A | 7/1995 | Sanwo et al. | |
| 5,441,613 | A | 8/1995 | McCormick et al. | 204/180.1 |
| 5,459,099 | A | 10/1995 | Hsu | |
| 5,490,117 | A | 2/1996 | Oda et al. | |
| 5,508,234 | A | 4/1996 | Dusablon, Sr. et al. | |
| 5,514,832 | A | 5/1996 | Dusablon, Sr. et al. | |
| 5,514,906 | A | 5/1996 | Love et al. | |
| 5,534,471 | A | 7/1996 | Carolan et al. | 502/4 |
| 5,544,696 | A | 8/1996 | Leland | |
| 5,548,605 | A | 8/1996 | Benett et al. | |
| 5,579,828 | A | 12/1996 | Reed et al. | |
| 5,585,069 | A | 12/1996 | Zanzucchi et al. | |
| 5,632,876 | A | 5/1997 | Zanzucchi et al. | 204/600 |
| 5,641,400 | A | 6/1997 | Kaltenbach et al. | |
| 5,658,831 | A | 8/1997 | Layton et al. | |
| 5,675,473 | A | 10/1997 | McDunn et al. | |
| 5,692,558 | A | 12/1997 | Hamilton et al. | |
| 5,696,405 | A | 12/1997 | Weld | |
| 5,703,536 | A | 12/1997 | Davis et al. | |
| 5,704,416 | A | 1/1998 | Larson et al. | |
| 5,727,618 | A | 3/1998 | Mundinger et al. | |
| 5,740,013 | A | 4/1998 | Roesner et al. | |
| 5,759,014 | A | 6/1998 | Van Lintel | |
| 5,763,951 | A | 6/1998 | Hamilton et al. | |
| 5,768,104 | A | 6/1998 | Salmonson et al. | |
| 5,774,779 | A | 6/1998 | Tuchinskiy | |
| 5,800,690 | A | 9/1998 | Chow et al. | |
| 5,801,442 | A | 9/1998 | Hamilton et al. | |
| 5,835,345 | A | 11/1998 | Staskus et al. | |
| 5,836,750 | A | 11/1998 | Cabuz | |
| 5,839,290 | A | 11/1998 | Nazeri | 62/119 |
| 5,858,188 | A | 1/1999 | Soane et al. | |
| 5,863,708 | A | 1/1999 | Zanzucchi et al. | |
| 5,869,004 | A | 2/1999 | Parce et al. | |
| 5,870,823 | A | 2/1999 | Bezama et al. | |
| 5,874,795 | A | 2/1999 | Sakamoto | |
| 5,876,655 | A | 3/1999 | Fisher | |
| 5,880,017 | A | 3/1999 | Schwiebert et al. | |
| 5,880,524 | A | 3/1999 | Xie | |
| 5,901,037 | A | 5/1999 | Hamilton et al. | |
| 5,921,087 | A | 7/1999 | Bhatia et al. | |
| 5,936,192 | A | 8/1999 | Tauchi | |
| 5,940,270 | A | 8/1999 | Puckett | |
| 5,942,093 | A | 8/1999 | Rakestraw et al. | |
| 5,964,092 | A | 10/1999 | Tozuka et al. | |
| 5,965,001 | A | 10/1999 | Chow et al. | |
| 5,965,813 | A | 10/1999 | Wan et al. | |
| 5,978,220 | A | 11/1999 | Frey et al. | |
| 5,989,402 | A | 11/1999 | Chow et al. | 204/601 |
| 5,993,750 | A | 11/1999 | Ghosh et al. | |
| 5,997,713 | A | 12/1999 | Beetz, Jr. et al. | |
| 5,998,240 | A | 12/1999 | Hamilton et al. | |
| 6,007,309 | A | 12/1999 | Hartley | |
| 6,010,316 | A | 1/2000 | Haller et al. | |
| 6,012,902 | A | 1/2000 | Parce | 417/48 |
| 6,013,164 | A | 1/2000 | Paul et al. | |
| 6,019,882 | A | 2/2000 | Paul et al. | |
| 6,054,034 | A | 4/2000 | Soane et al. | |
| 6,068,752 | A | 5/2000 | Dubrow et al. | |
| 6,090,251 | A | 7/2000 | Sundberg et al. | |
| 6,096,656 | A | 8/2000 | Matzke et al. | |
| 6,100,541 | A | 8/2000 | Nagle et al. | |
| 6,101,715 | A | 8/2000 | Fuesser et al. | |
| 6,103,199 | A * | 8/2000 | Bjornson et al. | 204/600 |
| 6,106,685 | A * | 8/2000 | McBride et al. | 204/600 |
| 6,119,729 | A | 9/2000 | Oberholzer et al. | |
| 6,126,723 | A | 10/2000 | Drost et al. | |
| 6,129,145 | A | 10/2000 | Yamamoto et al. | |
| 6,129,260 | A | 10/2000 | Andrus et al. | |
| 6,131,650 | A | 10/2000 | North et al. | |
| 6,140,860 | A | 10/2000 | Sandhu et al. | |
| 6,146,103 | A | 11/2000 | Lee et al. | |
| 6,154,363 | A | 11/2000 | Chang | |
| 6,159,353 | A | 12/2000 | West et al. | |
| 6,167,948 | B1 | 1/2001 | Thomas | |
| 6,171,067 | B1 | 1/2001 | Parce | |
| 6,174,675 | B1 | 1/2001 | Chow et al. | |

6,176,962 B1 1/2001 Soane et al.
6,186,660 B1 2/2001 Kopf-Sill et al.
6,206,022 B1 3/2001 Tsai et al.
6,210,986 B1 4/2001 Arnold et al.
6,216,343 B1 4/2001 Leland et al.
6,221,226 B1 4/2001 Kopf-Sill
6,227,809 B1 5/2001 Forster et al.
6,234,240 B1 5/2001 Cheon
6,238,538 B1 5/2001 Parce et al.
6,253,835 B1 7/2001 Chu et al.
6,277,257 B1 8/2001 Paul et al.
6,287,440 B1 9/2001 Arnold et al.
6,301,109 B1 10/2001 Chu et al.
6,313,992 B1 11/2001 Hildenbrandt
6,317,326 B1 11/2001 Vogel et al.
6,321,791 B1 11/2001 Chow
6,322,753 B1 11/2001 Lindberg et al.
6,324,058 B1 11/2001 Hsiao
6,337,794 B1 1/2002 Agonafer et al.
6,351,384 B1 2/2002 Daikoku et al.
6,366,467 B1 4/2002 Patel et al.
6,388,317 B1 5/2002 Reese
6,396,706 B1 5/2002 Wohlfarth
6,397,932 B1 6/2002 Calaman et al.
6,400,012 B1 6/2002 Miller et al.
6,406,605 B1 6/2002 Moles
6,415,860 B1 7/2002 Kelly et al.
6,416,642 B1 7/2002 Alajoki et al.
6,417,060 B1 7/2002 Tavkhelidze et al.
6,424,531 B1 7/2002 Bhatti et al.
6,437,981 B1 8/2002 Newton et al.
6,438,984 B1 8/2002 Novotny et al.
6,443,222 B1 9/2002 Yun et al.
6,444,461 B1 9/2002 Knapp et al.
6,457,515 B1 10/2002 Vafai et al.
6,459,581 B1 10/2002 Newton et al.
6,477,045 B1 11/2002 Wang
6,492,200 B1 12/2002 Park et al.
6,495,015 B1 12/2002 Schoeniger et al.
6,537,437 B1 3/2003 Galambos et al.
6,543,521 B1 4/2003 Sato et al.
6,553,253 B1 4/2003 Chang
6,572,749 B1 6/2003 Paul et al.
6,578,626 B1 6/2003 Calaman et al.
6,581,388 B1 6/2003 Novotny et al.
6,587,343 B1 7/2003 Novotny et al.
6,588,498 B1 7/2003 Reysin et al.
6,591,625 B1 7/2003 Simon
6,600,220 B1 7/2003 Barber et al.
6,606,251 B1 8/2003 Kenny, Jr. et al.
6,632,655 B1 10/2003 Mehta et al.
6,632,719 B1 10/2003 DeBoer et al. ..... 438/381
6,719,535 B1 * 4/2004 Rakestraw et al. ..... 417/48
6,729,383 B1 5/2004 Cannell et al.
6,743,664 B1 6/2004 Liang et al.
6,770,183 B1 8/2004 Hencken et al. ..... 204/600
2001/0016985 A1 8/2001 Insley et al.
2001/0024820 A1 9/2001 Mastromatteo et al.
2001/0044155 A1 11/2001 Paul et al.
2001/0045270 A1 11/2001 Bhatti et al.
2001/0046703 A1 11/2001 Burns et al.
2001/0055714 A1 12/2001 Cettour-Rose et al.
2002/0011330 A1 1/2002 Insley et al.
2002/0075645 A1 6/2002 Kitano et al.
2002/0096312 A1 7/2002 Korin ..... 165/58
2002/0121105 A1 9/2002 McCarthy, Jr. et al.
2002/0134543 A1 9/2002 Estes et al.
2003/0022505 A1 1/2003 Ouellet et al. ..... 438/704
2003/0062149 A1 4/2003 Goodson et al.
2003/0121274 A1 7/2003 Wightman
2004/0040695 A1 3/2004 Chesser et al.
2004/0052049 A1 3/2004 Wu et al.
2004/0089008 A1 5/2004 Tilton et al.
2004/0120827 A1 6/2004 Kim et al. ..... 417/48
2004/0125561 A1 7/2004 Gwin et al.
2004/0160741 A1 8/2004 Moss et al.
2004/0188069 A1 9/2004 Tomioka et al.

FOREIGN PATENT DOCUMENTS

JP 10-99592 4/1998
JP 2000-277540 10/2000
JP 2001-326311 11/2001

OTHER PUBLICATIONS

Kendra V. Sharp et al., "Liquid Flows in Microchannels", 2002, vol. 6, pp. 6-1 to 6-38.
Shuchi Shoji et al., "Microflow devices and systems", J. Microcech. Microeng. 4 (1994), pp. 157-171, printed in the U.K.
Angela Rasmussen et al., "Fabrication Techniques to Realize CMOS-Compatible Microfluidic Microchannels", Journal of Microelectromechanical, Vo. 10, No. 2, Jun. 2001, pp. 286-297.
J. H. Wang et al., "Thermal-Hydraulic Characteristic of Micro Heat Exchangers", 1991, DSC-vol. 32, Micromechanical Sensors, Actuators, and Systems, pp. 331-339.
Gad Hetsroni et al., "Nonuniform Temperature Distribution in Electronic Devices Cooled by Flow in Parallel Microchannels", IEEE Transactions on Components and Packaging Technologies, Mar. 2001, vol. 24, No. 1, pp. 16-23.
X. F. Peng et al., "Heat Transfer Characteristics of Water Flowing through Microchannels", Experimental Heat Transfer An International Journal, vol. 7, No. 4, Oct.-Dec. 1994, pp. 265-283.
Linan Jiang et al., "Forced Convection Boiling in a Microchannel Heat Sink", Journal of Microelectromechanical Systems, vol. 10, No. 1, Mar. 2001, pp. 80-87.
Muhammad M. Rahman et al., "Experimental Measurements of Fluid Flow and Heat Transfer in Microchannel Cooling Passages in a Chip Substrate", 1993, EEP-vol. 4-2, Advances in Electronic Packages, pp. 685-692.
X. F. Peng et al., "Forced convection and flow boiling heat transfer for liquid flowing through Microchannels", 1993, Int. J. Heat Mass Transfer, vol. 36, No. 14, pp. 3421-3427.
Lung-Jieh Yang et al., "A Micro Fluidic System of Micro Channels with On-Site Sensors by Silicon Bulk Micromaching", Sep. 1999, Microfluidic Devices and Systems II, vol. 3877, pp. 267-272.
G. Mohiuddin Mala et al., "Heat transfer and fluid flow in microchannels", 1997, Int. J. Mass transfer, vol. 40, No. 13, pp. 3079-3088, printed in Great Britain.
J. M. Cuta et al., "Fabrication and Testing of Micro-Channel Heat Exchangers", SPIE Microlithography and Metrology in Micromaching, vol. 2640, 1995, pp. 152-160.
Linan Jiang et al., "A Micro-Channel Heat Sink with Integrated Temperature Sensors for Phase Transition Study", 1999, 12th IEEE International Conference on Micro Electro Mechanical Systems, pp. 159-164.
Linan Jiang et al., "Fabrication and characterization of a microsystem for a micro-scale heat transfer study", J. Micromech. Microeng. 9 (1999) pp. 422-428, printed in the U.K.
M. B. Bowers et al., "High flux boiling in low flow rate, low pressure drop mini-channel and micro-channel heat sinks", 1994, Int. J. Heat Mass Transfer, vol. 37, No. 2, pp. 321-332.
Yongendra Joshi, "Heat out of small packages", Dec. 2001, Mechanical Engineer, pp. 56-58.

A. Rostami et al., "Liquid Flow and Heat Transfer in Microchannels: a Review", 2000, Heat and Technology, vol. 18, No. 2, pp. 59-68.
Lian Zhang et al., "Measurements and Modeling of Two-Phase Flow in Microchannels with Nearly Constant Heat Flux Boundary Conditions", Journal of Microelectromechanical Systems, vol. 11, No. 1, Feb. 2002, pp. 12-19.
Muhammad Mustafizur Rahman, "Measurements of Heat Transfer in Microchannel Heat Sinks", Int. Comm. Heat Mass Transfer, vol. 27, No. 4, May 2000, pp. 495-506.
Issam Mudawar et al., "Enhancement of Critical Heat Flux from High Power Microelectronic Heat Sources in a Flow Channel ", Journal of Electronic Packaging, Sep. 1990, vol. 112, pp. 241-248.
Nelson Kuan, "Experimental Evaluation of Micro Heat Exchangers Fabricated in Silicon", 1996, HTD-vol. 331, National Heat Transfer Conference, vol. 9, pp. 131-136.
E. W. Kreutz et al., "Simulation of micro-channel heat sinks for optoelectronic microsystems", Microelectronics Journal 31(2000) pp. 787-790.
J. C. Y. Koh et al., "Heat Transfer of Microstructure for Integrated Circuits", 1986, Int. Comm. Heat Mass Transfer, vol. 13, pp. 89-98.
Snezana Konecni et al., "Convection Cooling of Microelectronic Chips", 1992, InterSociety Conference on Thermal Phenomena, pp. 138-144.
Michael B. Kleiner et al., "High Performance Forced Air Cooling Scheme Employing Microchannel Heat Exchangers", 1995, IEEE Transactions on Components, Packaging, and Manufacturing Technology-Part A, vol. 18, No. 4, pp. 795-804.
Jerry K. Keska Ph. D. et al., "An Experimental Study on an Enhanced Microchannel Heat Sink for Microelectronics Applications", EEP-vol. 26-2, Advances in Electronic Packaging, 1999, vol. 2, pp. 1235-1259.
Shung-Wen Kang et al., "The Performance Test and Analysis of Silicon-Based Microchannel Heat Sink", Jul. 1999, Terahertz and Gigahertz Photonics, vol. 3795, pp. 259-270.
Joseph C. Tramontana, "Semiconductor Laser Body Heat Sink", Xerox Disclosure Journal, vol. 10, No. 6, Nov./Dec. 1985, pp. 379-381.
Sarah Arulanandam et al., "Liquid transport in rectangular microchannels by electroosmotic pumping", Colloid and Surfaces A: Physicochemical and Engineering Aspects 161 (2000), pp. 89-102.
Jeffery D. Barner et al., "Thermal Ink Jet Print Head Carriage with Integral Liquid Cooling Capabilities", Xerox Disclosure Journal-vol. 21, No. 1, Jan./Feb. 1996, pp. 33-34.
"Autonomous displacement of a solution in a microchannel by another solution", Research Disclosure, Jun. 2001, pp. 1046-1047.
John M. Waldvogel, "Aluminum Silicon Carbide Phase Change Heat Spreader", Motorola, Jun. 1999, Technical Developments, pp. 226-230.
James P. Slupe et al., "An idea for maintaining a stable thermal environment for electronic devices", Research Disclosure, Aug. 2001, p. 1312.
John M. Waldvogel, "A Heat Transfer Enhancement Method for Forced Convection Bonded-Fin Heatsinks", Motorola, Dec. 1997, Technical Developments, pp. 158-159.
"Thin Heat Pipe for Cooling Components on Printed Circuit Boards", IBM Technical Disclosure Bulletin, vol. 34, No. 7B, Dec. 1991, pp. 321-322.
R. C. Chu et al., "Process for Nucleate Boiling Enhancement", IBM Technical Disclosure Bulletin, vol. 18, No. 7, Dec. 1975, p. 2227.
J. Riseman, "Structure for Cooling by Nucleate Boiling", IBM Technical Disclosure Bulletin, vol. 18, No. 11, Apr. 1976, p. 3700.
"Integrally Grooved Semiconductor Chip and Heat Sink", Oct. 1971, IBM Technical Disclosure Bulletin, vol. 14, No. 5, p. 1425.
"Enhanced Cooling of Thermal Conduction Module", IBM Technical Disclosure Bulletin, vol. 30, No. 5, Oct. 1987, p. 426.
"Heat Exchanger Modules for Data Process with Valves Operated by Pressure form Cooling Water Pump", IBM Technical Disclosure Bulletin, vol. 30, No. 5, Oct. 1987, p. 419.
"Cold Plate for Thermal Conduction Module with Inlet for Cooling Water Near Highest Power Chips", IBM Technical Disclosure Bulletin, vol. 30, No. 5, Oct. 1987, p. 413.
"Circuit Module Cooling with Coaxial Bellow Providing Inlet, Outlet and Redundant Connections to Water-Cooled Element", IBM Technical Bulletin, vol. 30, No. 5, Oct. 1987, pp. 345-347.
"Piping System with Valves Controlled by Processor for Heating Circuit Modules in a Selected Temperature Profile for Sealing Integrity Test Under Temperature Stress", IBM Technical Disclosure Bulletin, vol. 30, No. 5, Oct. 1987, p. 336.
"Cooling System for Chip Carrier on Card", IBM Technical Disclosure Bulletin, vol. 31, No. 4, Sep. 1988, pp. 39-40.
"Chip Cooling Device", IBM Technical Disclosure Bulletin, vol. 30, No. 9, Feb. 1988, pp. 435-436.
W. E. Ahearn et al., "Silicon Heat Sink Method to Control Integrated Circuit Chip Operating Temperatures", IBM Technical Disclosure Bulletin, vol. 21, No. 8, Jan. 1979, pp. 3378-3380.
N. P. Bailey et al., "Cooling Device for Controlled Rectifier", IBM Technical Disclosure Bulletin, vol. 21, No. 11, Apr. 1979, pp. 4609-4610.
W. J. Kleinfelder et al., "Liquid-Filled Bellows Heat Sink", IBM Technical Disclosure Bulletin, vol. 21, No. 10, Mar. 1979, pp. 4125-4126.
R. P. Chrisfield et al., "Distributed Power/Thermal Control", IBM Technical Disclosure Bulletin, vol. 22, No. 3, Aug. 1979, pp. 1131-1132.
A. J. Arnold et al., "Heat Sink Design for Cooling Modules in a Forced Air Environment", IBM Technical Disclosure Bulletin, vol. 22, No. 6, Nov. 1979, pp. 2297-2298.
A. J. Arnold, "Structure for the Removal of Heat from an Integrated Circuit Module", IBM Technical Disclosure Bulletin, vol. 22, No. 6, Nov. 1979, pp. 2294-2296.
U. P. Hwang et al., "Cold Plate for Thermal Conduction Module with Improved Flow Pattern and Flexible Base", IBM Technical Disclosure Bulletin, vol. 25, No. 9, Feb. 1983, p. 4517.
K. C. Gallagher et al., "Cooling System for Data Processor with Flow Restricter in Secondary Loop to Limit Bypass-Cooling Water Flow", IBM Technical Disclosure Bulletin, vol. 26, No. 5, Oct. 1983, p. 2658.
R. C. Chu et al., "Silicon Heat Sink for Semiconductor Chip", IBM Technical Disclosure Bulletin, vol. 24, No. 11A, Apr. 1982, pp. 5743.
J. M. Eldridge et al., "Heat-Pipe Vapor Cooling Etched Silicon Structure", IBM Technical Disclosure Bulletin, vol. 25, No. 8, Jan. 1983, pp. 4118-4119.

J. R. Skobern, "Thermoelectrically Cooled Module", IBM Technical Disclose Bulletin, vol. 27, No. 1A, Jun. 1984, p. 30.
M. J. Brady et al., "Etched Silicon Integrated Circuit Heat Sink", IBM Technical Disclosure Bulletin, vol. 27, No. 1B, Jun. 1984, p. 627.
H. D. Edmonds et al., "Heat Exchange Element for Semiconductor Device Cooling", IBM Technical Disclosure Bulletin, vol. 23, No. 3, Aug. 1980, p. 1057.
R. W. Noth, "Heat Transfer from Silicon Chips and Wafers", IBM Technical Disclosure Bulletin, vol. 17, No. 12, May 1975, p. 3544.
"Forced Boiling Cooling System with Jet Enhancement for Crititical Heat Flux Extension", IBM Technical Disclosure Bulletin, vol. 39, No. 10, Oct. 1996, p. 143.
"Miniature Heat Exchanger for Corrosive Media", IBM Technical Disclosure Bulletin, vol. 38, No. 01, Jan. 1995, pp. 55-56.
"Self-Contained Active Heat Dissipation Device", IBM Technical Disclosure Bulletin vol. 39, No. 04, Apr. 1996, pp. 115-116.
C. J. Keller et al., "Jet Cooling Cup for Cooling Semiconductor Devices", IBM Technical Disclosure Bulletin, vol. 20, No. 9, Feb. 1978, pp. 3575-3576.
B. J. Ronkese, "Centerless Ceramic Package with Directly Connected Heat Sink", IBM Technical Disclosure Bulletin, vol. 20, No. 9, Feb. 1978, p. 3577-3578.
K. S. Sachar, "Liquid Jet Cooling of Integrated Circuit Chips", vol. 20, No. 9, Feb. 1978, pp. 3727-3728.
A. H. Johnson, "Device Cooling", IBM Technical Disclosure Bulletin, vol. 20, No. 10, Mar. 1978, pp. 3919-3920.
A. L. Pacuzzo et al., "Integrated Circuit Module Package Cooling Structure", IBM Technical Disclosure Bulletin, vol. 20, No. 10, Mar. 1978, pp. 3898-3899.
R. D. Durand et al., "Flexible Thermal Conductor for Electronic Module", IBM Technical Disclosure Bulletin, vol. 20, No. 11A, Apr. 1978, p. 4343.
D. Balderes et al., "Liquid Cooling of a Multichip Module Package", IBM Technical Disclosure Bulletin, vol. 20, No. 11A, Apr. 1978, pp. 4336-4337.
J. A. Dorler et al., "Temperature Triggerable Fluid Coupling System for cooling Semiconductor Dies", IBM Technical Disclosure Bulletin, vol. 20, No. 11A, Apr. 1978, pp. 4386-4388.
V. W. Antonetti et al., "Integrated Module Heat Exchanger", IBM Technical Disclosure Bulletin, vol. 20, No. 11A, Apr. 1978, p. 4498.
P. Hwang et al., "Conduction Cooling Module", IBM Technical Disclosure Bulletin, vol. 20, No. 11A, Apr. 1978, pp. 4334-4335.
A. J. Arnold, "Electronic Packaging Structure", IBM Technical Disclosure Bulletin, vol. 20, No. 11B, Apr. 1978, pp. 4820-4822.
V. Y. Doo et al., "High Performance Package for Memory", IBM Technical Disclosure Bulletin, vol. 21, No. 2, Jul. 1978, pp. 585-586.
"Multi-Chip Package with Cooling by a Spreader Plate in Contact with a Chip having Cylindrical Holes Mating with an Inverse Frame Providing Water Flow Within its Pins", IBM Technical Disclosure Bulletin, vol. 31, No. 5, Oct. 1988, pp. 141-142.
J. Landrock et al., "Cooling System for Semiconductor Chips", IBM Technical Disclosure Bulletin, vol. 23, No. 4, Sep. 1980, p. 1483.
E. P. Damm, Jr., "Convection Cooling Apparatus", IBM Technical Disclosure Bulletin, vol. 20, No. 7, Dec. 1977, pp. 2755-2756.
"Circuit Package with Circulating Boiling Liquid and Local Heat Exchanger to Limit Vapor in Coolant Outlet", IBM Technical Disclosure Bulletin, vol. 31, No. 12 May 1989, p. 34.
"Circuit Module Cooling with Multiple Pistons Contacting a Heat Spreader/Electrical Buffer Plate in Contact with Chip", IBM Technical Disclosure Bulletin, vol. 31, No. 12, May 1989, p. 5-7.
"TCM-LIKE Circuit Module with Local Heat Sink Resting on Chip and Chip Separated From Coolant by Bellows with Pins and Deflector Plate Attached to Local Heat Sink and Extending Above Bellows into Region of Coolant Flow", IBM Technical Disclosure Bulletin, vol. 31, No. 11, pp. 305-306.
"Water-Cooled Circuit Module with Grooves Forming Water Passages Near Heat-Producing Devices", IBM Technical Disclosure Bulletin, vol. 31, No. 12, May 1989, pp. 49-50.
"Cold Plate for Thermal conduction Module with Only Peripheral Mounting bolts, Large Surface Area Fin Inserts and Reduced Water Flow and Thermal Resistances", IBM Technical Disclosure Bulletin, vol. 31, No. 12, May 1989, p. 59.
"Thermal Control Hardware for Accelerated Run-In Testing of Multi-Chip Modules", IBM Technical Disclosure Bulletin, vol. 32, No. 5A, Oct. 1989, p. 129-130.
"Means of Removing More Heat From a TCM (Or Other Liquid-Cooled Logic Package) By Reducing the Coolant Temperature", IBM Technical Disclosure Bulletin, vol. 32 No. 5A, Oct. 1989, pp. 153-154.
E. G. Loeffel et al., "Liquid Cooled Module with Compliant Membrane", IBM Technical Disclosure Bulletin, vol. 20, No. 2, Jul. 1977, pp. 673-674.
V. Y. Doo et al., "Method of Effective Cooling of a High Power Silicon Chip", IBM Technical Disclosure Bulletin, vol. 20, No. 4, Sep. 1977, p. 1436-1437.
V. Y. Doo et al., Semiconductor Chip Cooling Package, IBM Technical Disclosure Bulletin, vol. 20, No. 4, Sep. 1977, pp. 1440-1441.
"Heat Sink Fabrication Method", IBM Technical Disclosre Bulletin, vol. 27, No. 10A, Mar. 1985, p. 5656-5657.
"Thermal Conduction Module with Liquid Dielectric and Pistons with Surface Treatment for Enhanced Nucleate Boiling", IBM Technical Disclosure Bulletin, vol. 27, No. 12, May 1985, p. 6904.
"Pin Fin Array Heat Pipe Apparatus", IBM Technical Disclosure Bulletin, vol. 37, No. 09, Sep. 1994, p. 171.
Youngcheol Joo et al., "Fabrication of Monolithic Microchannels for IC Chip Cooling", 1995, IEEE Micro Electro Mechanical Systems, pp. 362-367.
Jaisree Moorthy et al., *Active control of electroosmotic flow in microchannels using light,* Jan. 26, 2001, Sensors and Actuators B 75, pp. 223-229.
Andreas Manz et al., *Electroosmotic pumping and electrophoretic separations for miniaturized chemical analysis systems,* Sep. 16, 1994, J.Micromech. Microeng. 4 (1994), pp. 257-265, printed in the U.K.
E. B. Cummings et al., *Irrotationality of uniform electroosmosis,* Sep. 1999, Part of the SPIE Conference on Microfluidic Devices and Systems II, SPIE vol. 3877, pp. 180-189.

Stephen C. Jacobson et al., *Fused Quartz Substrates for Microchip Electrophoresis,* Jul. 1, 1995, Analytical Chemistry, vol. 67, No. 13, pp. 2059-2063.
Haim H. Bau, *Optimization of conduits' shape in micro heat exchangers,* Dec. 10, 1997, International Journal of Heat and Mass Transfer 41 (1998), pp. 2717-2723.
V. K. Dwivedi et al., *Fabrication of very smooth walls and bottoms of silicon microchannels for heat dissipation of semiconductor devices,* Jan. 25, 2000, Microelectronics Journal 31 (2000), pp. 405-410.
M. B. Bowers et al.,, *Two-Phase Electronic Cooling Using Mini-Channel and Micro-Channel Heat Sinks: Part 2-Flow Rate and Pressure Drop Constraints,* Dec. 1994, Journal of Electronic Packaging 116, pp. 298-305.
Meint J. de Boer et al., *Micromachining of Buried Micro Channels in Silicon,* Mar. 2000, Journal of Microelectromechanical systems, vol. 9, No. 1, pp. 94-103.
S.B. Choi et al., *Fluid Flow and Heat Transfer in Microtubes,* 1991, DSC-vol. 32, Micromechanical sensors, Actuators, and Systems, ASME 1991, pp. 123-134.
S. F. Choquette, M. Faghri et al., *Optimum Design of Microchannel Heat Sinks,* 1996, DSC-vol. 59, Microelectromechanical Systems (MEMS), ASME 1996, pp. 115-126.
David Copeland et al., *Manifold Microchannel Heat Sinks: Theory and Experiment,* 1995, EEP-vol. 10-2, Advances in Electronic Packaging ASME 1995, pp. 829-835.
J. M. Cuta et al., *Forced Convection Heat Transfer in Parallel Channel Array Microchannel Heat Exchanger,* 1996, PID-vol. 2 / HTD-vol. 338, Advances in Energy efficiency, Heat/Mass Transfer Enhancement, ASME 1996, pp. 17-23.
K. Fushinobu et al., *Heat Generation and Transport in Sub-Micron Semiconductor Devices,* 1993, HTD-vol. 253, Heat Transfer on the Microscale, ASME 1993, pp. 21-28.
Charlotte Gillot et al., *Integrated Micro Heat Sink For Power Multichip Module,* Sep. 3, 1999, IEEE Transactions on Industry Applications, vol. 36, No. 1. Jan./Feb. 2000, pp. 217-221.
John Gooding, *Microchannel heat exchangers—a review,* SPIE vol. 1997 High Heat Flux Engineering II (1993), pp. 66-82.
Koichiro Kawano et al., *Micro Channel Heat Exchanger for Cooling Electrical Equipment,* HTD-vol. 361-3/PID-vol. 3, Proceeding of the ASME Heat Transfer Division—vol. 3, ASME 1998, pp. 173-188.
Chad Harris et al., *Design and Fabrication of a Cross Flow Micro Heat Exchanger,* Dec. 2000, Journal of Microelectromechanical Systems, vol. 9, No. 4, pp. 502-508.
George M. Harpole et al., *Micro-Channel Heat Exchanger Optimization,* 1991, Seventh IEEE SEMI-THERM Symposium, pp. 59-63.
Pei-Xue Jiang et al., *Thermal-hydraulic performance of small scale micro-channel and prous-media heat-exchangers,* 2001, International Journal of Heat and Mass Transfer 44 (2001), pp. 1039-1051.
X.N. Jiang et al., *Laminar Flow Through Microchannels Used for Microscale Cooling Systems,* 1997, IEEE/CPMT Electronic Packaging Technology Conference, pp. 119-122, Singapore.
David Bazeley Tuckerman, *Heat-Transfer Microstructures for Integrated Circuits,* Feb. 1984, pp. ii-xix, pp. 1-141.
M Esashi, *Silicon micromachining for integrated microsystems,* 1996, Vacuum/vol. 47/Nos. 6-8/pp. 469-474.
T.S. Raviguruajan et al., *Effects of Heat Flux on Two-Phase Flow characteristics of Refrigerant Flows in a Micro-Channel Heat Exchanger,* HTD-vol. 329, National Heat Transfer Conference, vol. 7, ASME 1996, pp. 167-178.
T.S. Ravigruruajan et al., *Single-Phase Flow Thermal Performance Characteristics of a Parallel Micro-Channel Heat Exchanger,* 1996, HTD-vol. 329, National Heat Transfer Conference, vol. 7, ASME 1996, pp. 157-166.
T.S. Ravigururajan et al., *Liquid Flow Characteristics in a Diamond-Pattern Micro-Heat-Exchanger,* DSC-vol. 59 Microelectromechanical Systems (IMEMS), ASME 1996, pp. 159-166.
T.S. Raviguruajan, *Impact of Channel Geometry on Two-Phase Flow Heat Transfer Characteristics of Refrigerants in Microchannel Heat Exchangers,* May 1998, Journal of Heat Transfer, vol. 120, pp. 485-491.
J. Pfahler et al., *Liquid Transport in Micron and Submicron Channels,* Mar. 1990, Sensors and Actuators, A21-A23 (1990), pp. 431-434.
Kenneth Pettigrew et al., *Performance of a MEMS based Micro Capillary Pumped Loop for Chip-Level Temperature Control,* 2001, The 14th IEEE International Conference on Micro Electro Mechanical Systems, pp. 427-430.
C. Perret et al., *Microchannel integrated heat sinks in silicon technology,* Oct. 12-15, 1998, The 1998 IEEE Industry Applications Conference, pp. 1051-1055.
X.F. Peng et al., *Convective heat transfer and flow friction for water flow in microchannel structures,* 1996, Int. J. Heat Mass Transfer, vol. 39, No. 12, pp. 2599-2608, printed in Great Britain.
X.F. Peng et al., *Experimental investigation of heat transfer in flat plates with rectangular microchannels,* 1994, Int. J. Heat Mass Transfer, vol. 38, No. 1, pp. 127-137, printed in Great Britain.
X.F. Peng et al., *Cooling Characteristics with Microchanneled Structures,* 1994, Enhanced Heat Transfer, vol. 1, No. 4, pp. 315-326, printed in the United States of America.
Yoichi Murakami et al., *Parametric Optimization of Multichananneled Heat Sinks for VLSI Chip Cooling,* Mar. 2002, IEEE Transaction on Components and Packaging Technologies, vol. 24, No. 1, pp. 2-9.
D. Mundinger et al., *High average power 2-D laser diode arrays or silicon microchannel coolers,* CLEO '89/Friday Morning/404.
L.J. Missaggia et al., *Microchannel Heat Sinks for Two-Dimensional High-Power-Density Diode Laser Arrays,* 1989, IEEE Journal of Quantum Electronics, vol. 25, No. 9, Sep. 1989, pp. 1989-1992.
M.J. Marongiu et al., *Enhancement of Multichip Modules (MCMs) Cooling by Incorporating MicroHeatPipes and Other High Thermal Conductivity Materials into Microchannel Heat Sinks,* 1998, Electronic Components and Technology Conference, pp. 45-50.
C.R. Friedrich et al., *Micro heat exchangers fabricated by diamond machining,* Jan. 1994, Precision Engineering, vol. 16, No. 1, pp. 56-59.
Mali Mahalingam, *Thermal Management in Semiconductor Device Packaging,* 1985, Proceedings of the IEEE, vol. 73, No. 9, Sep. 1985, pp. 1396-1404.
T.M. Adams et al., *An experimental investigation of single-phase forced convection in microchannels,* 1997, Int. J. Heat Mass Transfer, vol. 41, Nos. 6-7, pp. 851-857, Printed in Great Britain.
T.M. Adams et al., *Applicability of traditional turbulent single-phase forced convection correlations to non-circular*

*micrhchannels,* 1999, Int. J. Heat and Transfer 42 (1999) pp. 4411-4415.
Bassam Badran et al.; *Experimental Results for Low-Temperature Silicon Micromachined Micro Heat Pipe Arrays Using Water and Methanol as Working Fluids,* May 31, 1997, Experimental Heat Transfer, 10: pp. 253-272.
D. Jed Harrison et al., *Electroosmotic Pumping Within A Chemical Sensor System Integrated on Silicon,* Session C9 Chemical Sensors and Systems for Liquids, Jun. 26, 1991, pp. 792-795.
Kurt Seller et al., *Electroosmotic Pumping and Valveless Control of Fluid Flow within a Manifold of Capillaries on a Glass Chip,* 1994, Analytical Chemistry, vol. 66, No. 20, Oct. 15, 1994, pp. 3485-3491.
Philip H. Paul et al., *Electrokinetic Generation of High Pressures Using Porous Microstructures,* 1998, Micro-Total Analysis Systems, pp. 49-52.
Gh. Mohiuddin Mala et al., *Flow characteristics of water through a microchannel between two parallel plates with electrokinetic effects,* 1997, Int. J. Heat and Fluid Flow, vol. 18, No. 5, pp. 489-496.
W.E. Morf et al., *Partial electroosmotic pumping in complex capillary systems Part 1: Principles and general theoretical approach,* Oct. 16, 2000, Sensors and Actuators B 72 (2001), pp. 266-272.
M. Esashi, *Silicon micromachining and micromachines,* Sep. 1, 1993, Wear, vol. 168, No. 1-2, (1993), pp. 181-187.
Stephanus Buttgenbach et al., *Microflow devices for miniaturized chemical analysis systems,* Nov. 4-5, 1998, SPIE-Chemical Microsensors and Applications, vol. 3539, pp. 51-61.
Sarah Arunlanandam et al., *Liquid transport in rectangular microchannels by electroosmotic pumping,* 2000, Colloids and Surfaces A: Physicochemical and Engineering Aspects vol. 161 (2000), pp. 89-102.
Linan Jiang et al., *Closed-Loop Electroosmotic Microchannel Cooling System for VLSI Circuits,* Mechanical Engineering Dept. Stanford University, pp. 1-27.
Susan L. R. Barker et al., *Fabrication, Derivatization and Applications of Plastic Microfluidic Devices,* Proceedings of SPIE, vol. 4205. Nov. 5-8, 2000, pp. 112-118.
Timothy E. McKnight et al., *Electroosmotically Induced Hydraulic Pumping with Integrated Electrodes on Microfluidic Devices,* 2001, Anal. Chem., vol. 73, pp. 4045-4049.
Chris Bourne, *Cool Chips plc Receives Nanotech Manufacturing Patent,* Jul. 31, 2002, pp. 1-2.
Frank Wagner et al., *Electroosmotic Flow Control in Micro Channels Produced by Scanning Excimer Laser Ablation ,* 2000, Proceedings of SPIE vol. 4088, Jun. 14-16, 2000, pp. 337-340.
H. A. Goodman, *Data Processor Cooling With Connection To Maintain Flow Through Standby Pump,* Dec. 1983, IBM Technical Disclosure Bulletin, vol. 26, No. 7A, p. 3325.
*Electroerosion Micropump,* May 1990, IBM Technical Disclosure Bulletin, vol. 32, No. 12, pp. 342-343.
Shulin Zeng et al., *Fabrication and Characterization of Electrokinetic Micro Pumps,* 2000 Inter Society Conference on Thermal Phenomena, pp. 31-35.
A. Manz et al., *Integrated Electoosmotic Pumps and Flow Manifolds for Total Chemical Analysis System,* 1991, Inter. Conf. on Solid-State Sensors and Actuators, pp. 939-941.
O. T. Guenat et al., *Partial electroosmotic pumping in complex capillary systems Part: 2 Fabrication and application of a micro total analysis system suited for continuous volumetric nanotitrations,* Oct. 16, 2000, Sensors and Actuators B 72 (2001) pp. 273-282.
J. G. Sunderland, *Electrokinetic dewatering and thickening. I. Introduction and historical review of electrokinetic applications,* Sep. 1987, Journal of Applied Electrochemistry vol. 17, No. 5, pp. 889-898.
J. C. Rife et al., *Acousto- and electroosmotic microfluidic controllers,* 1998, Microfluidic Devices and Systems, vol. 3515, pp. 125-135.
Purnendu K Dasgupta et al., *Electroosmosis: A Reliable Fluid Propulsion System for Flow Injection Analysis,* 1994, Anal. Chem., vol. 66, No. 11, pp. 1792-1798.
Ray Beach et al., *Modular Microchannel Cooled Heatsinks for High Average Power Laser Diode Arrays,* Apr. 1992, IEEE Journal of Quantum Electronics, vol. 28, No. 4, pp. 966-976.
Roy W. Knight et al., *Optimal Thermal Design of Air cooled Forced Convection finned Heat Sinks—Experimental Verification,* Oct. 1992, IEEE Transactions on Components, Hybrids, and Manufacturing Technology, vol. 15, No. 5 pp. 754-760.
Y. Zhuang et al., *Experimental study on local heat transfer with liquid impingement flow in two-dimensional microchannels,* 1997, Int. J. Heat Mass Transfer, vol. 40, No. 17, pp. 4055-4059.
D. Yu et al., *An Experimental and Theoretical Investigation of Fluid Flow and Heat Transfer in Microtube,* 1995, ASME / JSME Thermal Engineering Conference, vol. 1, pp. 523-530.
Xiaoqing Yin et al., *Micro Heat Exchangers Consisting of Pin Arrays,*1997, Journal of Electronic Packaging Mar. 1997, vol. 119, pp. 51-57.
X. Yin et al., *Uniform Channel Micro Heat Exchangers,* 1997, Journal of Electronic Packaging Jun. 1997, vol. 119, No. 2, pp. 89-94.
Chun Yang et al., *Modeling forced liquid convection in rectangular microchannels with electrokinetic effect,* 1998, International Journal of Heat and Mass Transfer 41 (1998), pp. 4229-4249.
Arel Weisberg et al., *Analysis of microchannels for integrated cooling,* 1992, Int. J. Heat Mass Transfer, vol. 35, No. 10, pp. 2465-2473.
Roger S. Stanley et al., *Two-Phase Flow in Microchannels,* 1997, DSE-vol. 62/HTD-vol. 354, MEMS, pp. 143-152.
B. X. Wang et al., *Experimental investigation on liquid forced-convection heat transfer through microchannels,* 1994, Int. J. Heat Mass Transfer, vol. 37, Suppl. 1, pp. 73-82.
Kambiz Vafai et al., *Analysis of two-layered micro-channel heat sink concept in electronic cooling,* 1999, Int. J. Heat Mass Transfer, 42 (1999), pp. 2287-2297.
Gokturk Tune et al., *Heat transfer in rectangular microchannels,* 2002, Int. J. Heat Mass Transfer, 45 (2002), pp. 765-773.
D. B. Tuckerman et al., *High-Performance Heat Sinking for VLSI,* 1981, IEEE Electron Device Letters, vol. EDL-2, No. 5, pp. 126-129.
Bengt Sunden et al., *An Overview of Fabrication Methods and Fluid Flow and Heat Transfer Characteristics of Micro Channels,* pp. 3-23.
David S. Shen et al., *Micro Heat Spreader Enhance Heat Transfer in MCMs,* 1995, IEEE Multi-Chip Module Conference, pp. 189-194.
S. Sasaki et al., *Optimal Structure for Microgrooved Cooling Fin for High-Power LSI Devices,* Electronic Letters, Dec. 4, 1986, vol. 22, No. 25.

Vijay K. Samalam, *Convective Heat Transfer in Microchannels,* Sep. 1989, Journal of Electronic Materials, vol. 18, No. 5, pp. 611-617.

Sanjay K. Roy et al., *A Very High Heat Flux Microchannel Heat Exchanger for Cooling of Semiconductor Laser Diode Arrays,* 1996, IEEE Transactions on components, packaging, and manufacturing technology-part B, vol. 19, No. 2, pp. 444-451.

Charlotte Gillot et al., *Integrated Single and Two-Phase Micro Heat Sinks Under IGBT Chips,* IEEE Transactions on Components and Packaging Technology, vol. 22 No. 3, Sep. 1999, pp. 384-389.

X.F. Peng et al., "Enhancing the Critical Heat Flux Using Microchanneled Surfaces", Enhanced Heat Transfer, 1998, vol. 5, pp. 165-176.

H. Krumm "Chip Cooling", IBM Technical Disclosure Bulletin, vol. 20, No. 7, Dec. 1977, p. 2728.

Jae-Mo Koo et al., "Modeling of Two-Phase Microchannel Heat Sinks for VLSI Chips", Mech. Eng. Depart. of Stanford University, pp. 422-426.

* cited by examiner

MICRO-FABRICATED ELECTROKINETIC PUMP WITH ON-FRIT ELECTRODE

RELATED APPLICATIONS

This Patent Application is a continuation-in-part of U.S. patent application Ser. No. 10/366,121, filed Feb. 12, 2003 now U.S. Pat. No. 6,881,039 which claims priority under 35 U.S.C. 119 (e) of the co-pending U.S. Provisional Patent Application Ser. No. 60/413,194 filed Sep. 23, 2002, and entitled "MICRO-FABRICATED ELECTROKINETIC PUMP". In addition, this Patent Application claims priority under 35 U.S.C. 119 (e) of the co-pending U.S. Provisional Patent Application Ser. No. 60/442,383, filed Jan. 24, 2003, and entitled "OPTIMIZED PLATE FIN HEAT EXCHANGER FOR CPU COOLING". The co-pending patent application Ser. No. 10/366,211 as well as the two co-pending Provisional Patent Applications, Ser. No. 60/413,194 and 60/422,383 are also hereby incorporated by reference.

FIELD OF THE INVENTION

The present invention relates to an apparatus for cooling and a method thereof. In particular, the present invention is directed to a frit based pump or electroosmotic pump with on-frit electrode and method of manufacturing thereof.

BACKGROUND OF THE INVENTION

High density integrated circuits have evolved in recent years including increasing transistor density and clock speed. The result of this trend is an increase in the power density of modern microprocessors and an emerging need for new cooling technologies. At Stanford, research into 2-phase liquid cooling began in 1998, with a demonstration of closed-loop systems capable of 130 W heat removal. One key element of this system is an electrokinetic pump, which was capable of fluid flow on the order of ten of ml/min against a pressure head of more than one atmosphere with an operating voltage of 100V.

This demonstration was carried out with liquid-vapor mixtures in the microchannel heat exchangers, because there was insufficient liquid flow to capture all the generated heat without boiling the liquid. Conversion of some fraction of the liquid to vapor imposes a need for high-pressure operation, and increases the operational pressure requirements for the pump. Furthermore, two phase flow is less stable during the operation of a cooling device and can lead to transient fluctuations and difficulties in controlling the chip temperature.

In such small electrokinetic pumps, the position as well as the distance of the electrodes in relation to the porous structure is very important. Inconsistency in the distances between electrodes on each side of the porous structure pump result in variations in the electric field across the porous structure. These variations in the electric field affect the flow rate of the fluid through the pump and cause the pump to operate inefficiently. In prior art electroosmotic pumps 10 as shown in FIG. 6, the electrodes 12,14 are spaced apart periodically along the top and bottom surface 18, 20 of the pump. Voltage provided to the electrodes 12,14 from a power source (not shown) creates an electric field across the pump 10, whereby the electrical field generated by the electrodes 12, 14 forces the fluid to travel through the channels from the bottom side to the top side. Thus, variations in the electric field causes the porous structure to pump more fluid in areas where there is a stronger electric field and pump less fluid through areas where the electric field is weaker.

Periodically spaced electrodes 12,14 along the surfaces 18,20 of the pump 10 can create a non-uniform electric field across the porous structure 10. As shown in FIG. 6, cathodes 12A–12F are placed apart from one another on the top surface 18 of the pump 10, whereas anodes 14B–14F are placed apart from one another on the bottom surface of the pump 10. However, as shown in FIG. 6, the anode 14B is directly below the cathode 12B, but not directly below the cathode 12A. Thus, an electric field is generated between the electrodes 12A and 14B as well as the electrodes 12B and 14B. It is well known that the electric field in between a pair of electrodes becomes greater as the distance between the pair of electrodes becomes smaller. Thus, the electrical field is dependent on the distance between electrodes 12,14. In the pump shown in FIG. 6, the distance between electrodes 12A and 14B is greater than the distance between electrodes 12B and 14B. Therefore, the electrical field between the electrodes 12A and 14B is weaker than the electrical field between the electrodes 12B and 14B. Since, the variation in the electrical field across the porous structure 10 causes inconsistencies in the amount of fluid pumped through different areas of the pump 10 more fluid will be pumped through the areas of the pump 10 where the electrical field is greater than the areas in the pump 10 where the electrical field is weaker. For instance, electrodes 12E and 14C are located directly across the pump 10 from one another and have a high electrical field therebetween. However, the electrode 12D is located proximal to, but not directly above, the anode 14C, whereby current passes between anode 14C and cathode 12D and the voltage generates an electrical field therebetween. However, there may be little or no electrical field in the porous structure 10 between cathode 12D and anode 14E. The absence or lack of electrical field between the electrodes 12D and 14E leaves the areas between electrodes 12D and 14E of the pump 10 with less current passing therethrough. As a result, less fluid is pumped through the portion between electrodes 12D and 12E in the pump 10.

What is needed is an electrokinetic or electroosmotic pumping element that provides a relatively large flow and pressure within a compact structure and offers better uniformity in pumping characteristics across the pumping element.

SUMMARY OF THE INVENTION

In one aspect of the invention, an electroosmotic pump comprises at least one porous structure which pumps fluid therethrough. The porous structure preferably has a first roughened side and a second roughened side. The porous structure has a first continuous layer of electrically conductive material with an appropriate first thickness disposed on the first side as well as a second continuous layer of electrically conductive material with a second thickness disposed on the second side. The first and second thicknesses is within the range between and including 200 Angstroms and 10,000 Angstroms. At least a portion of the first layer and the second layer allows fluid to flow therethrough. The pump also includes means for providing electrical voltage to the first layer and the second layer, thereby producing an electrical field therebetween. The providing means is coupled to the first layer and the second layer. The pump also includes an external means for generating power that is sufficient to pump fluid through the porous structure at a desired rate. The means for generating is coupled to the means for providing.

In another aspect of the invention, an electroosmotic porous structure is adapted to pump fluid therethrough. The porous structure preferably includes a first rough side and a second rough side and a plurality of fluid channels therethrough. The first side has a first continuous layer of electrically conductive material that is deposited thereon. The second side has a second continuous layer of electrically conductive material that is deposited thereon. The first layer and the second layer are coupled to an external power source, wherein the power source supplies a voltage differential between the first layer and the second layer to drive fluid through the porous structure at a desired flow rate.

In yet another aspect of the invention, a method of manufacturing electroosmotic pump comprises the steps of forming at least one porous structure which preferably has a first rough side and a second rough side and a plurality of fluid channels therethrough. The method includes the step of depositing a first continuous layer of electrically conductive material of appropriate thickness to the first side which is adapted to pass fluid through at least a portion of the first layer. The method also includes the step of depositing a second continuous layer of electrically conductive material of appropriate thickness to the second side adapted to pass fluid through at least a portion of the second layer. The method further comprises the steps of coupling a power source to the first continuous layer and the second continuous layer and applying an appropriate amount of voltage to generate a substantially uniform electric field across the porous structure.

In one embodiment, the electrically conductive material is disposed as a thin film electrode. Alternatively, the electrically conductive material is disposed as a screen mesh which has an appropriate electrically conductivity. Each individual fiber in the screen mesh is separated by a distance that is smaller or larger than a cross-sectional width of the porous structure. Alternatively, the electrically conductive material includes a plurality of conductive beads which have a first diameter and are in contact with one another to pass electrical current therebetween. In an alternative embodiment, at least one of the plurality of beads has a second diameter that is larger than the first diameter beads. Alternatively, a predetermined portion of the continuous layer of electrically conductive material has a third thickness, whereby the predetermined portion of the continuous layer is disposed on the surface of the porous structure in one or more patterns. In an alternative embodiment, at least a portion of an non-porous outer region of the porous structure is made of borosilicate glass, Quartz, Silicon Dioxide, or porous substrates with other doping materials. The electrically conductive material is preferably made of Platinum, but is alternatively made of other materials. In one embodiment, the first layer and the second layer are made of the same electrically conductive material. In another embodiment, the first layer and the second layer are made of different electrically conductive materials. The electrically conductive material is applied by variety of methods, including but not limited to: evaporation; vapor deposition; screen printing; spraying; sputtering; dispensing; dipping; spinning; using a conductive ink; patterning; and shadow masking.

Other features and advantages of the present invention will become apparent after reviewing the detailed description of the preferred embodiments set forth below.

DETAILED DESCRIPTION OF THE PREFERRED EMBODIMENT

Figure 1A:
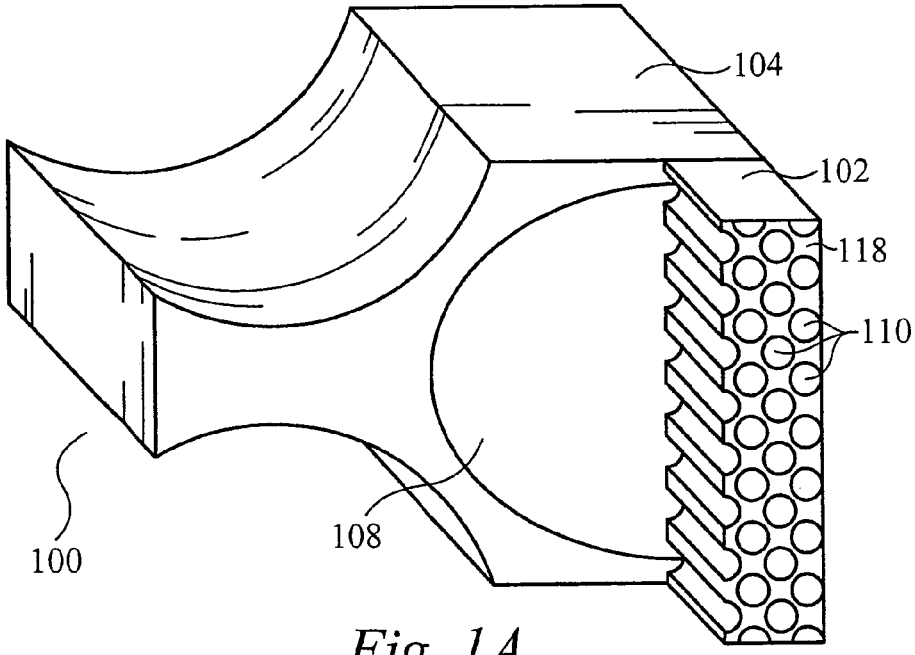
FIG. 1A illustrates a perspective view of the pumping element in accordance with the present invention.

Reference will now be made in detail to the preferred and alternative embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which are included within the spirit and scope of the invention as defined by the appended claims. Furthermore, in the following detailed description of the present invention, numerous specific details are set forth in order to provide a thorough understanding of the present invention. However, it should be noted that the present invention is able to be practiced without these specific details. In other instances, well known methods, procedures, components, and circuits have not been described in detail as not to unnecessarily obscure aspects of the present invention.

The basic performance of an electrokinetic or electroosmotic pump is modeled by the following relationships:

$$Q = \frac{\Psi\zeta}{\tau}\frac{\varepsilon VA}{\mu L}\left(1 - \frac{2\lambda I_1(a/\lambda_D)}{aI_o(a/\lambda_D)}\right) \quad (1)$$

-continued $$\Delta P = \frac{8\varepsilon\zeta V}{a^2}\left(1 - \frac{2\lambda I_1(a/\lambda_D)}{aI_o(a/\lambda_D)}\right) \quad (2)$$

As shown in equations (1) and (2), Q is the flow rate of the liquid flowing through the pump and ΔP is the pressure drop across the pump and the variable a is the diameter of the pore aperture. In addition, the variable ψ is the porosity of the pore apertures, ζ is the zeta potential, ϵ is the permittivity of the liquid, V is the voltage across the pore apertures, A is the total Area of the pump, τ is the tortuosity, μ is the viscosity and L is the thickness of the pumping element. The terms in the parenthesis shown in equations (1) and (2) are corrections for the case in which the pore diameters approach the size of the charged layer, called the Debye Layer, $\lambda_D$, which is only a few nanometers. For pore apertures having a diameter in the 0.1 micrometer to 0.1 mm range, these expressions simplify to be approximately:

$$Q = \frac{\Psi\zeta}{\tau}\frac{\varepsilon VA}{\mu L} \quad (3)$$

$$\Delta P = \frac{8\varepsilon\zeta V}{a^2} \quad (4)$$

As shown in equations (3) and (4). The amount of flow and pressure are proportional to the amount of voltage potential that is present. However, other parameters are present that affect the performance of the pump. For example, the tortuosity (τ) describes the length of a channel relative to the thickness of the pumping element and can be large for pumps with convoluted, non-parallel channel paths. The length (L) is the thickness of the pumping element. As shown in equations (3) and (4), the tortuosity τ and thickness L of the pumping element are inversely proportional to the flow equation (4) without appearing at all in the pressure equation (4). The square of the diameter a of the pore apertures is inversely proportional to the pressure equation (4) without appearing at all in the flow equation (3).

FIG. 1A illustrates one embodiment of the pump 100 in accordance with the present invention. It should be noted the individual features of the pump 100 shown in the figures herein are exaggerated and are for illustrative purposes. The pump 100 includes a pumping element or body 102 and a support element 104. The pumping element 102 includes a thin layer of silicon with a dense array of cylindrical holes, designated as pore apertures 110. Alternatively, the pumping element 102 is made of any other appropriate material. The pumping element has a thickness range of 10 microns to 10 millimeters and the pore apertures 110 have a diameter of 0.1–2.0 microns. In addition, the pumping element 102 includes electrode 118 on its surface, whereby the electrodes on either sides of the pumping element 102 drive the fluid through the pumping element 102. In particular, the voltage applied to the pumping element 102 causes the negatively electrically charged ions in the liquid to be attracted to the positive voltage applied to the top surface of the pumping element 102. Therefore, the voltage potential between the top and bottom surface of the pumping element drives the liquid through the pore apertures 110 to the top surface, whereby the liquid leaves the pump 100 at substantially the same temperature as the liquid entering the pump.

Figure 1B:
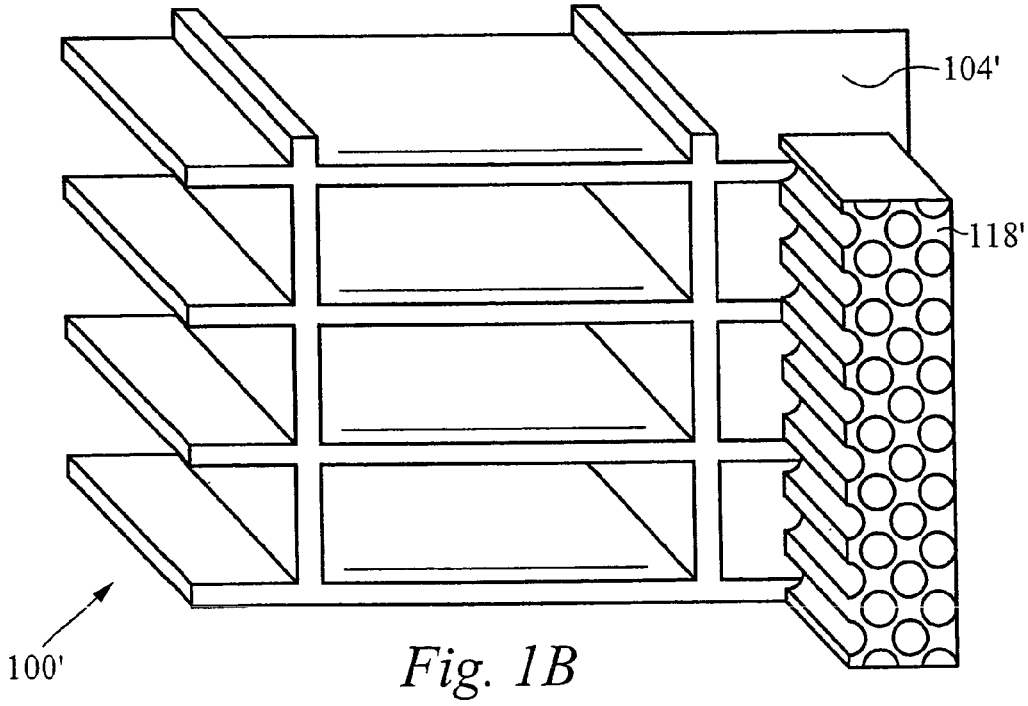
FIG. 1B illustrates a perspective view of the pumping element in accordance with the present invention.
Figure 2:
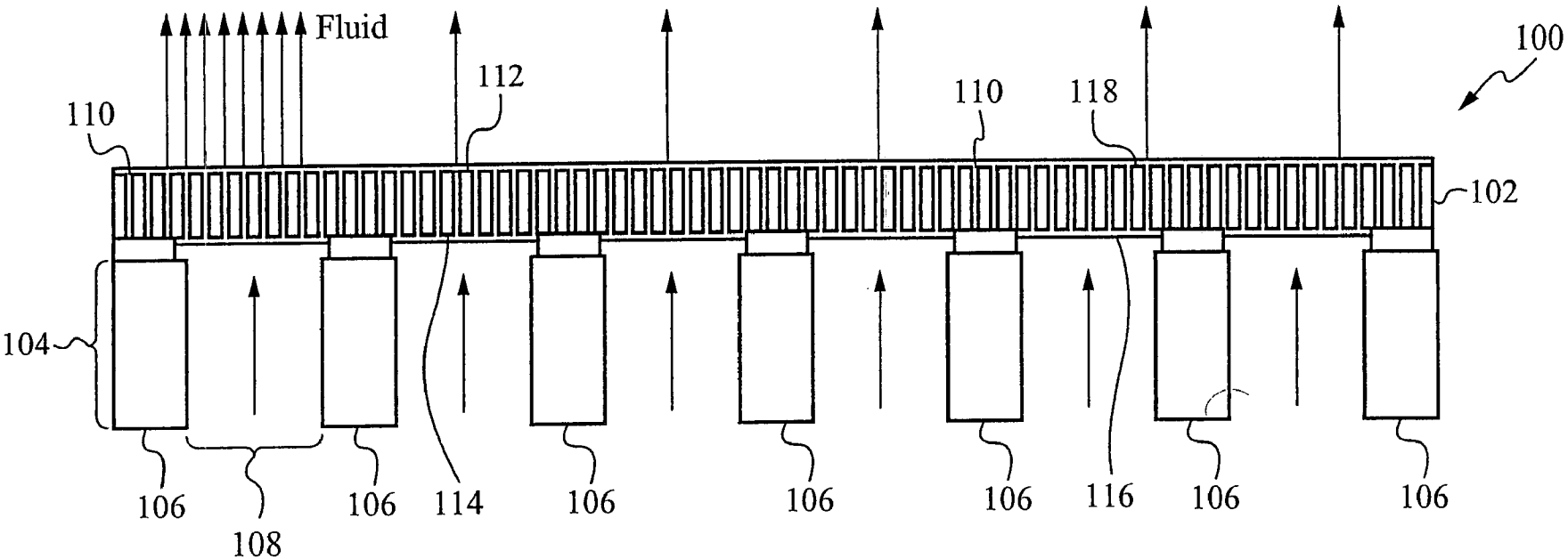
FIG. 2 illustrates a cross sectional view of the pump in accordance with the present invention.

As shown in FIGS. 1 and 2, the pumping element 102 is alternatively supported by the support element 104 having a less dense array of much larger holes or support apertures 108. It should be noted that the support element 104 is not required, whereby the pump 100 is operational without the support element 104. The optional support element 104 provides mechanical support to the pumping element 102. The optional support element 104 made of Silicon has a thickness of 400 microns. The support apertures 108 are at least 100 microns in diameter. It is apparent to one skilled in the art that other thicknesses and diameters are contemplated. The illustration of the support structures 108 in FIG. 1A is only one type of configuration and it should be noted that other geometric structures is alternatively used to balance mechanical strength with ease of fabrication. Such alternative structures include a honeycomb lattice of material, a square lattice of material, a spiderweb-lattice of material, or any other structural geometry that balances mechanical strength with ease of fabrication. FIG. 1B illustrates an example of a square lattice structure 100'.

FIG. 2 illustrates a cross sectional view of the pump 100 of the present invention. As shown in FIG. 2, the pumping element 102 includes a dense array of pore apertures 110 and the support element 104 attached to the pumping element 102, whereby the support element 104 includes an array of support structures 106. The pore apertures 110 pass through the pumping element 102 between its bottom surface 114 to its top surface 112. In particular, the pore apertures 110 channel liquid from the bottom surface 114 to the top surface 112 of the pumping element 102 and are substantially parallel to each other, as shown in FIG. 2. The liquid used in the pump 100 of the present invention is water with an ionic buffer to control the pH and conductivity of the liquid. Alternatively, other liquids are used including, but not limited to, acetone, acetonitrile, methanol, alcohol, ethanol, water having other additives, as well as mixtures thereof. It is contemplated that any other suitable liquid is contemplated in accordance with the present invention.

The support structures 106 are attached to the pumping element 102 at predetermined locations of the bottom surface 114 of the pumping element 102. These predetermined locations are dependent on the required strength of the pump 100 in relation to the pressure differential and flow rate of the liquid passing through the pumping element 102. In between each support structure 106 is a support aperture 108, whereby the liquid passes from the support apertures 108 into the pore apertures 110 in the bottom surface 114 of the pumping element 102. The liquid then flows from the bottom pore apertures 110 through the channels of each pore apertures and exits through the pore apertures 110 opening in the top surface 112 of the pumping element 102. Though the flow is described as liquid moving from the bottom surface 114 to the top surface 112 of the pumping element 102, it will be apparent that reversing the voltage will reverse the flow of the liquid in the other direction.

The liquid passes through the pumping element 102 under the process of electo-osmosis, whereby an electrical field is applied to the pumping element 102 in the form of a voltage differential. As shown in FIG. 2, electrode layers 116, 118 are disposed on the top surface 112 and bottom surface 114 of the pumping element 102, respectively. The voltage differential supplied by the electrodes 118, 116 between the top surface 112 and the bottom surface 114 of the pumping element 102 drives the liquid from the area within support apertures 108 up through the pore apertures 110 and out through top surface 112 of the pumping element 102.

Although the process of electro-osmosis is briefly described here, the process is well known in the art and will not be described in any more detail.

Figure 3:
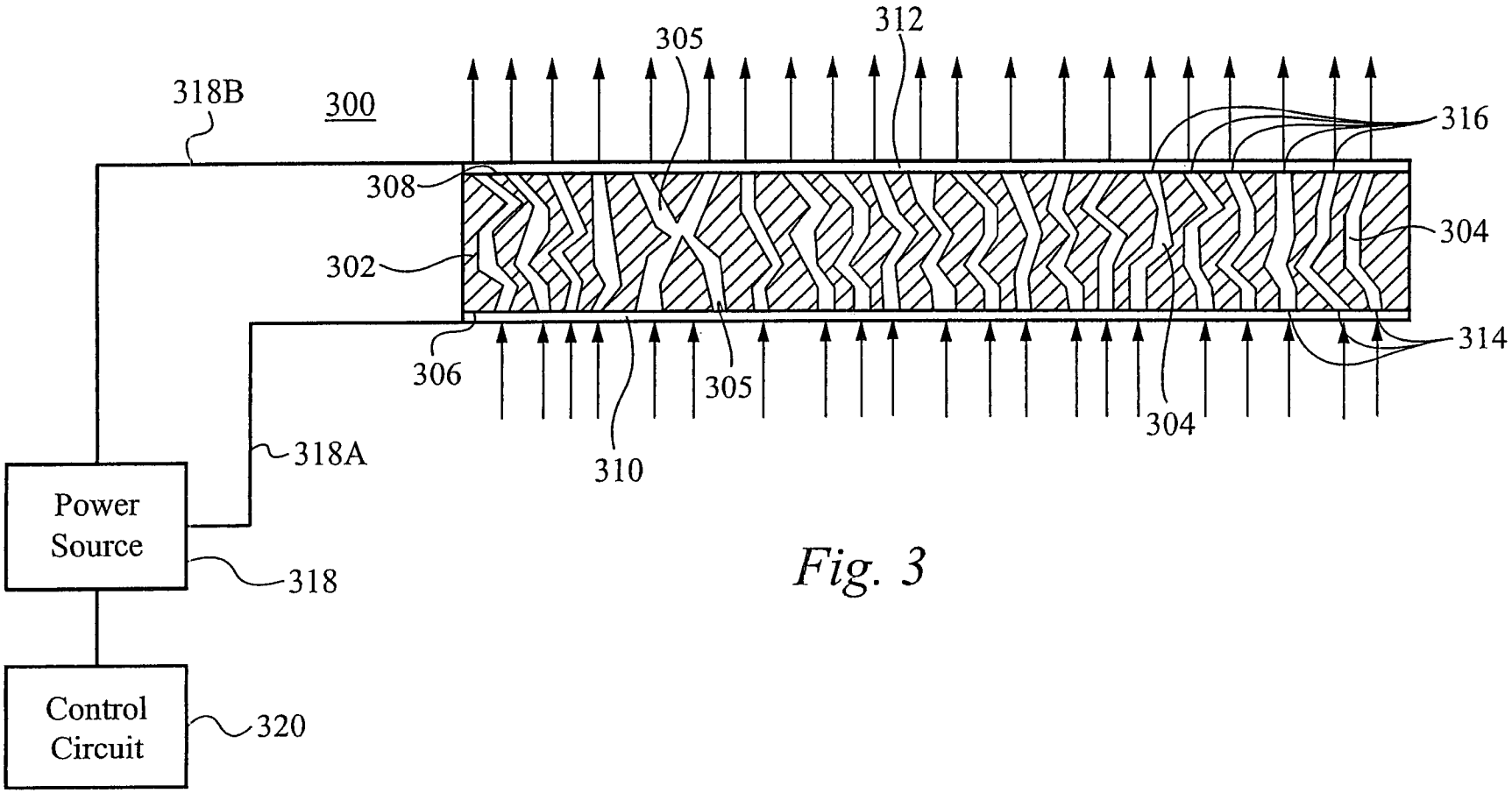
FIG. 3 illustrates the preferred embodiment frit having non-parallel pore apertures in accordance with the present invention.

FIG. 3 illustrates a preferred embodiment of the pumping element of the present invention. Preferably, the pumping element 300 shown in FIG. 3 includes a body having a top surface 308 and a bottom surface 306. The body 302 includes pore apertures 316 in the top surface 308 and pore apertures 314 in the bottom surface 306. The body 302 includes several non-parallel conduits 304 that channel fluid from the pore apertures 314 in the bottom surface 306 to the pore apertures 316 in the top surface 308. In one embodiment, the pore apertures 314 and the pore apertures 316 are not evenly spaced to be aligned across the height dimension of the pump body 302. In another embodiment, the pore apertures 314 and 316 are aligned across the height dimension of the pump body 302.

In one embodiment, at least one of the conduits 304 has a uniform diameter between the pore apertures 314, 316. In another embodiment, at least one of the conduits 304 has a varying diameter between the pore apertures 314, 316. In another embodiment, two or more conduits 305 in the pump body 302 are cross connected, as shown in FIG. 3. The pump structure 300 in FIG. 3 is advantageous, because it is manufacturable at a very low cost using a glass sintering process which is well known in the art. Once the basic porous glass body 302 has been produced, it is possible to deposit or form the electrodes 312, 310 directly on the top and bottom surfaces 308, 306 of the pumping structure 300 using any appropriate method as discussed below.

Figure 5A:
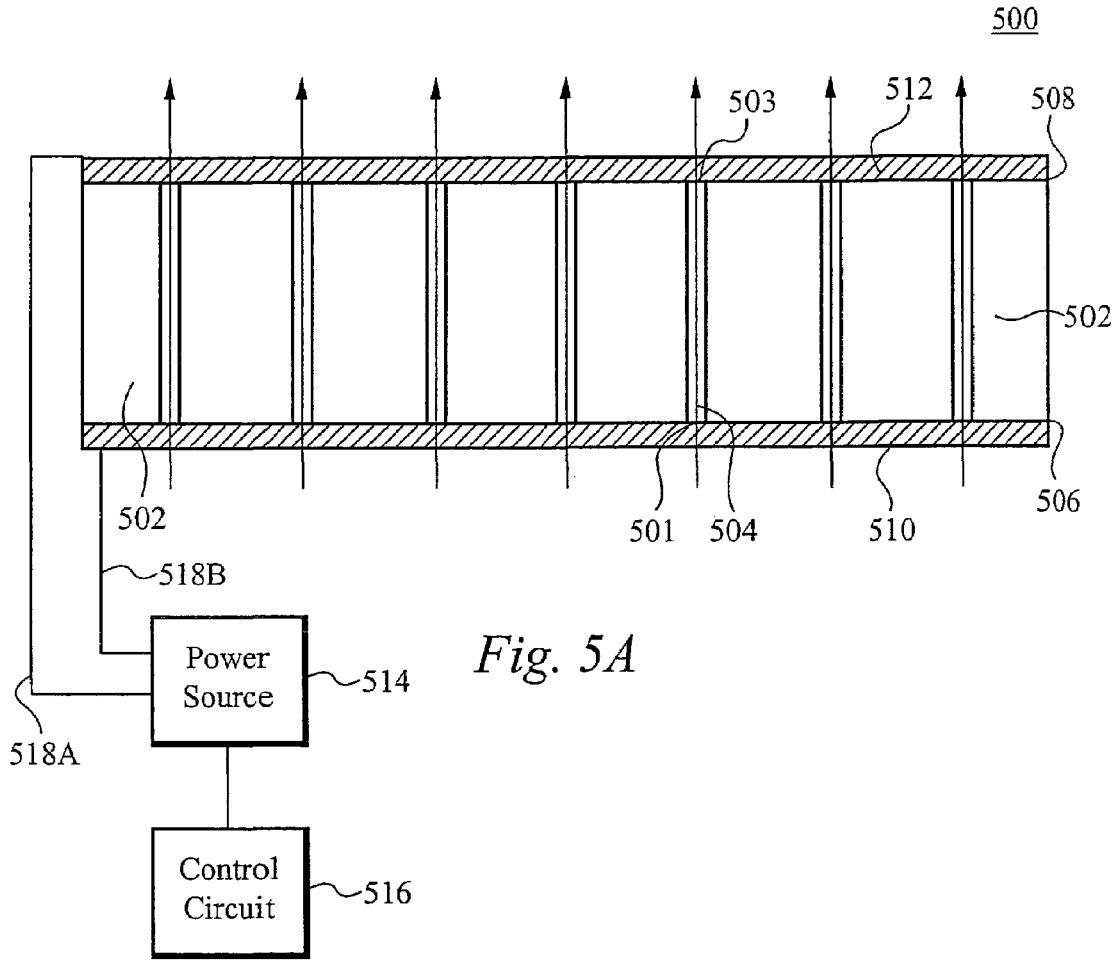
FIG. 5A illustrates a schematic of an embodiment of the pump including the applied electrode layer in accordance with the present invention.

FIG. 5A illustrates a schematic view of the pump 500 having the electrode layer applied thereto in accordance with the present invention. The pump 500 includes the pump body 502 with a dense array of pore apertures 501 in the bottom surface 506 and pore apertures 503 in the top surface 508. The pump body 502 includes conduits 504 which channel fluid from the bottom side 506 and the top side 508 of the body 502. The pump 500 in FIG. 5A is shown to have straight and parallel pore apertures 504 for exemplary purposes. However, as stated above, the pump 500 preferably has a pump body which includes non-parallel and non straight pore apertures and conduits, as shown in FIG. 3.

A layer of the electrode 510 is disposed upon the bottom side 506 of the body 502. In addition, a layer of the electrode 512 is applied to the top side of the body 502. The pump 500 is coupled to an external power source 514 and an external control circuit 516 by a pair of wires 518A and 518B. Alternatively, any other known methods of coupling the power source 514 and circuit 516 to the pump 500 are contemplated. The power source is any AC or DC power unit which supplies the appropriate current and voltage to the pump 500. The control circuit 516 is coupled to the power source 514 and variably controls the amount of current and voltage applied to the pump 500 to operate the pump at a desired flowrate.

The electrode layer 510 on the top surface 508 is a cathode electrode and the electrode layer 512 on the bottom surface 506 is an anode electrode. The electrode layers 510, 512 are made of a material which is highly conductive and has porous characteristics to allow fluid to travel therethrough. The porosity of the electrode layers 510, 512 are dependent on the type of material used. The electrode layers 510, 512 also have a sufficient thickness which generate the desired electrical field across the pump 500. In addition, the thickness and composition of material in the electrode layers 510, 512 allow the electrode layers 510, 512 to be applied to the pump body surfaces 506,508 which have a particular roughness. Alternatively, the pump body surfaces 506, 508 are smooth, whereby the electrode layers 510, 512 are applied to the smooth surfaces 506, 508. The electrode layers 510, 512 preferably provide a uniform surface along both sides of the pump body 502 to generate a uniform electric field across the pump 500.

Figure 5B:
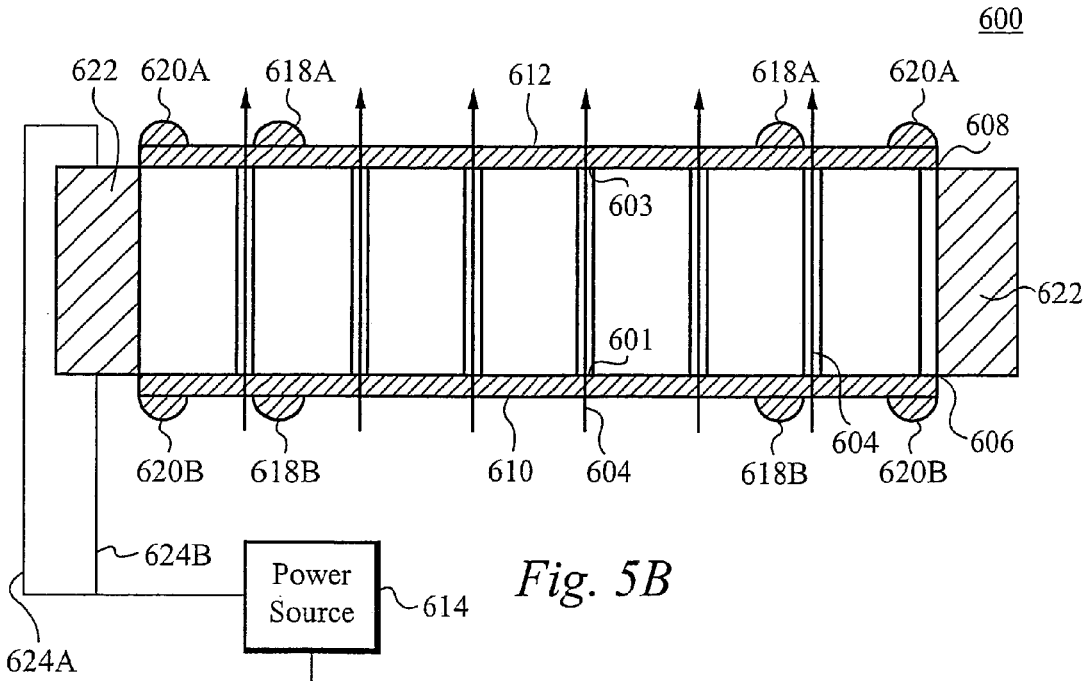
FIG. 5B illustrates a schematic of an alternative embodiment of the pump including the applied electrode layer in accordance with the present invention.
Figure 5C:
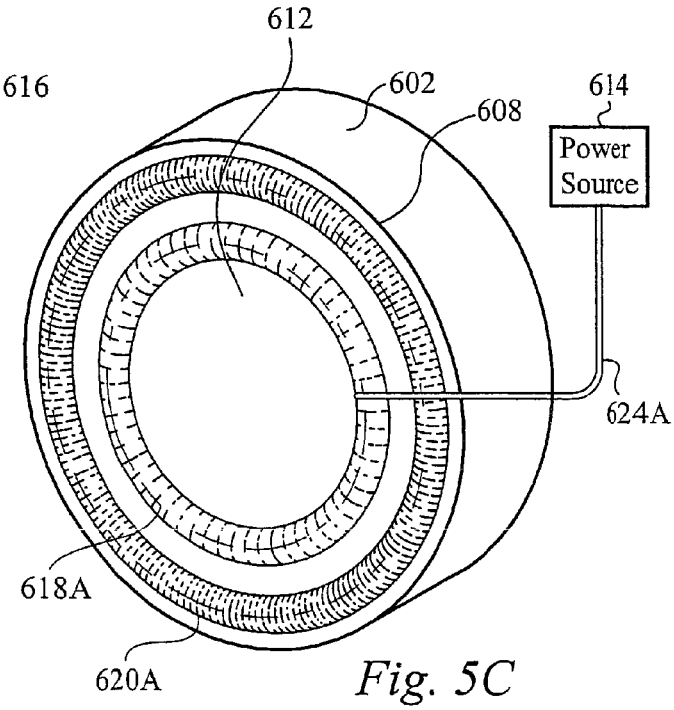
FIG. 5C illustrates a perspective view of the alternative embodiment of the pump including the applied electrode layer in accordance with the present invention.
Figure 5D:
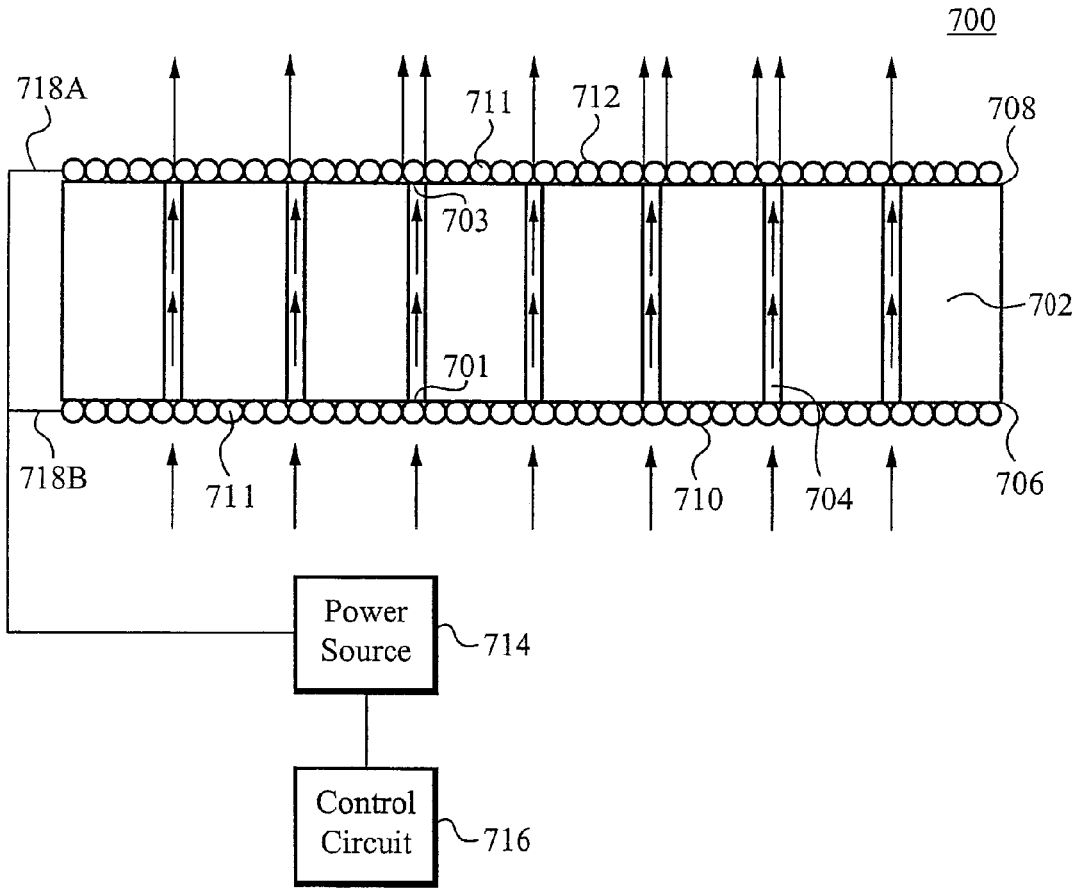
FIG. 5D illustrates a schematic view of an alternative embodiment of the pump including the applied electrode layer in accordance with the present invention.

The electrode layers 510, 512 are disposed on the surfaces 506, 508 of the pump body 502 as a thin film, as shown in FIG. 5A. Alternatively, the electrode layers 510, 512 are disposed on the surfaces 506, 508 as a stratum of multiple layers of film, as shown in FIG. 5B. In another embodiment, the electrode layers 510, 512 include a several small spheres aligned along the surface and in contact with one another, as shown in FIG. 5D. It should be noted that other configurations of the electrode layers are contemplated by one skilled in the art, wherein the electrode layer generates a substantially uniform electrical field and allows fluid to pass therethrough.

As shown in FIG. 5A, the thin film of electrode has an even, consistent thickness along the entire surfaces of the pump body 502. In one embodiment, the thin film is continuous along the entire surface of the pump body 502, whereby there are no breaks, cracks, or discontinuity in the films 510, 512. In one embodiment, the thin films of electrodes 510, 512 are evenly spaced apart from each other across the pump body 502. In addition, the thin films of electrodes 510, 512 have the same thickness so that the electrode layers 510, 512, when charged, generate a uniform electric field across the pump body 502. The thin film electrodes 510,512 have a thickness such that the electrode is continuous over the pump body 502 surface and also allows fluid to travel through the pump body 502. The thickness of the electrode is within the range of and including 200 and 100,000 Angstroms and preferably has a thickness of 1000 Angstroms. However, it is preferred that the electrodes 510, 512 has a thickness to provide a modest resistance path, such as less than 100 ohms, from one edge of the pumping element to the other edge.

Alternatively, the pump body 502 is configured with multiple layers of electrodes 618, 620 as shown in FIG. 5B. FIG. 5C illustrates a perspective view of the pump 600 shown in FIG. 5B. As shown in FIG. 5C, the pump 500 has a disk shape. However, it is contemplated that the pump 500 alternatively has any other shape and is not limited to the shape shown in FIG. 5C. The pump 600 in FIG. 5B is shown to have straight and parallel pore apertures 604 for exemplary purposes. However, as stated above, the pump 600 includes non-parallel and non straight pore apertures, as shown in FIG. 3.

The pump 600 includes a thin film electrode 612 disposed on the top surface 608 as well as another thin film electrode 610 disposed on the bottom surface 606. In addition, as shown in FIGS. 5B and 5C, the pump 600 includes a second electrode layer 618, 620 disposed on top of the thin film electrode 610, 612. The combined thin film electrode 612 and additional electrode layer thereby forms a multi-layer electrode 618, 620. In one embodiment, the additional electrode layer applied to the thin film electrode 610, 612 is made of the same material, thereby forming a homogeneous multi-layer electrode 618, 620. Alternatively, the additional electrode layer applied to the thin film electrode 610, 612 is made of a different material, thereby forming a composite multi-layer electrode 618, 620.

The multi-layer electrodes 618, 620 are disposed at predetermined locations along the top and bottom surfaces 610,612 of the pump 600. As shown in FIG. 5B, the multi-layer electrodes 618B, 620B disposed on the bottom surface 606 of the pump 600 are disposed to be in the same location opposite of the multi-layer electrodes 618A, 620A. Alternatively, the multi-layer electrodes 618B, 620B on the bottom surface 606 are disposed not to be in the same location opposite from the multi-layer electrodes 618A, 620A.

As shown in FIG. 5C, the multi-layer electrodes are disposed as two concentric rings or circles 618A, 618B, 620A, 620B on the top surface 608 and the bottom surface 606 (FIG. 5B). It is apparent to one skilled in the art that the multi-layer electrodes 618, 620 are alternatively disposed as any number of concentric circles. Alternatively, any number of concentric circles are contemplated on the top and bottom surfaces 608, 606 of the pump 600. It is apparent to one skilled in the art that it is not necessary that the multi-layered electrodes 618, 620 be disposed as concentric circles, and alternatively have any other appropriate design or configuration. In addition, the electrode layers disposed on top of the thin film electrodes 610, 612 are shown in FIGS. 5B and 5C as having a semi-circular cross section. However, the additional electrode layers disposed on the thin film 610, 612 alternatively have any other cross-sectional shape, including but not limited to square, rectangular, triangular and spherical.

In one embodiment, the additional electrode layer is disposed on the surface of the pump as a circular ring with respect to the center. Alternatively, the additional electrode layer is disposed along the surface of the pump 700 in any other configuration, including, but not limited to, cross-hatches, straight line patterns and parallel line patterns. In another embodiment, the pump 600 alternatively has the multi layer electrodes 618, 620 which cover a substantial area of the pump surface 606, 608, whereby the thin film electrodes 610, 612 form notches or indents into the multi layer electrode surfaces 618, 620. Thus, a smaller electrical field is present proximal to the locations of the notches, whereas a larger electrical field is present elsewhere across the pump body 600.

In comparison to the thin film electrodes 610, 612, the multilayer electrodes 618 are capable of distributing larger total currents without generating large voltage drops. In some cases, these currents are as large as 500 mA, whereby the total resistance of the electrode is less than 10 ohms. The multilayer electrodes 618 provide a number of very low-resistance current paths from one edge of the pumping element to other locations on the surface of the pumping element. The thicker electrodes in this design will block a portion of the pores within the pump body, thereby preventing fluid to flow through the pump at those pore locations. It should be noted that all of the pores are not blocked, however. In one embodiment, the thicker electrode regions occupy no more than 20% of the total area of the pumping element. Therefore, at least 80% of the pores in the pumping element are not blocked and are available to pump the fluid therethrough.

FIG. 5D illustrates another alternative embodiment of the pump of the present invention. The electrode layer 710, 712 include several spherical beads in contact with the top and bottom surface 708, 706 of the pump 700 as well as in contact with one another. The power source 714 and control circuit 706 are coupled to the beaded electrode layer 711 to supply current and voltage thereto. The pump 700 in FIG. 5D is shown to have straight and parallel pore apertures 701, 703 and conduits 704 for exemplary purposes. However, as stated above, the pump 700 alternatively includes non-parallel and non straight pore apertures, as shown in FIG. 3. As shown in FIG. 5D, a pair of connecting wires 718A, 718B are coupled to the beaded electrode layers, whereby the connecting wires 718A, 718B deliver current to electrode layers 711. The wires 718A, 718B are coupled to an external power source 714 as well as a control circuit 716.

The beads 711 are made of an electrically conductive material and are in contact with one another along the entire surface of the pump body 702. Alternatively, the beaded electrode layer 711 is disposed partially on the surface of the pump body 702. The beads 711 allow electrical current to pass along the top and bottom surface 712, 710 of the pump body 702 to form a voltage potential across the pump 700. The beads 711 are spherical and have a diameter range in between and including 1 micron and 500 microns. In one embodiment, the diameter of the beads 711 is 100 microns such that the beads do not block the pores in the pumping element while providing uniform distribution of the electric field and current which is larger than 1 millimeter in area. The beads 711 in the electrode layers 710, 712 are in contact with the corresponding top and bottom surfaces 708, 706 of the pump body 702. Due to the spherical shape of the beads 711, small gaps or openings are formed in between the beads 711 when placed in contact with one another. Fluid is thereby able to flow through the pump body 702 by flowing through the gaps in between the beads 711 in the bottom and top electrode layers 710, 712. It is preferred that the beads 711 are securely attached to the top and bottom surfaces 706, 708 of the pump body 702 and do not detach from the pump body 702 due to the force from the fluid being pumped therethrough. However, it is understood that the beads 711 are alternatively placed in any other appropriate location with respect to the pump body 702. For instance, the beads 711 are not attached to surfaces 706, 708, but are alternatively packed tightly within an enclosure (not shown), such as a glass pump housing, which houses the pump body 702.

Figure 5E:
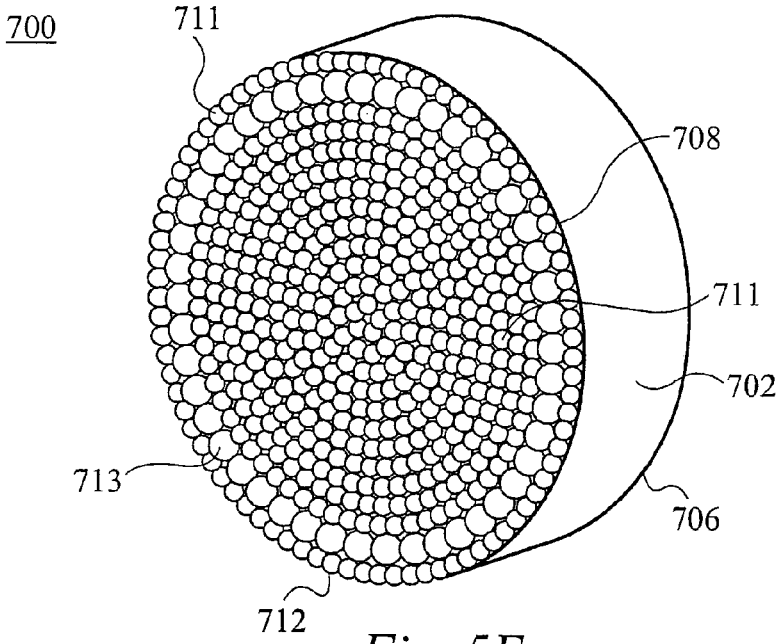
FIG. 5E illustrates a perspective view of the alternative embodiment of the pump including the applied electrode layer shown in FIG. 5D.

Alternatively, the beaded electrode layer 711 is configured to have a predetermined number of larger diameter beads 713 among the smaller diameter beads in the beaded electrode layer 711. The larger beads 713 are within the range and including 100 microns and 500 microns, whereas the smaller beads (not shown) are within the range and including 1 micron and 25 microns. With respect to the surface of the pump body, the larger diameter beads 713 will present a thicker electrode layer than the smaller diameter beads. As with the multi-layer electrodes 618, 620 (FIG. 5C), the larger diameter beads 713 are placed in predetermined locations of the pump body 702 such that the fluid is able to sufficiently flow through the pump body 702. As shown in FIG. 5E, the larger beads 713 are disposed in a circular ring among the smaller beads 711. Alternatively, the larger beads 713 are disposed along the surface of the pump 700 in any other configuration. It should be noted that the spherical beads 711 are alternatively disposed on the thin film electrodes 510, 512 in FIG. 5A.

In the above figures, the cathode electrode 512 and anode electrodes 510 are charged by supplying voltage from the power source 514 to the electrodes 510, 512. As shown in FIGS. 5A and 5D, the power source is coupled to the pump 500 by a pair of wires 518A, 518B, whereby the wires 518A, 518B are physically in contact with the electrode layers 510, 512. Alternatively, as shown in FIG. 5B, the outer perimeter of the pump in FIG. 5B is made of solid fused-glass 622, whereby the wires 624A, 624B are physically coupled to the conducting surface on the fused glass portion 622 and provide electrical current to the electrodes 610, 612 through the conducting surface on fused glass portion 622.

The fused glass portion 622 of the pump 600 provides one or more rigid non-porous surfaces to attach the pump 600 to a pump housing (not shown) or other enclosure. The fused glass portion 622 is attached to one or more desired surfaces by soldering, thereby avoiding the use of solder wicking through the frit and shorting out the pump 600. It is apparent to one skilled in the art that other methods of attaching the fused glass portion 622 to the desired surfaces are contemplated. The fused glass is preferably made of borosilicate glass. Alternatively, other glasses or ceramics are used in the outer perimeter of the pump including, but not limited to Quartz, pure Silicon Dioxide and insulating ceramics. In one embodiment, the pump 600 includes the fused glass portion 622 along the entire outer perimeter. In another embodiment, the pump 600 includes the fused glass portion 622 along one side of the pump body 602. In addition, it is contemplated that the fused glass portion 622 is not limited to the embodiment in FIG. 5B, and are also be applied to the other pump embodiments.

Figure 5F:
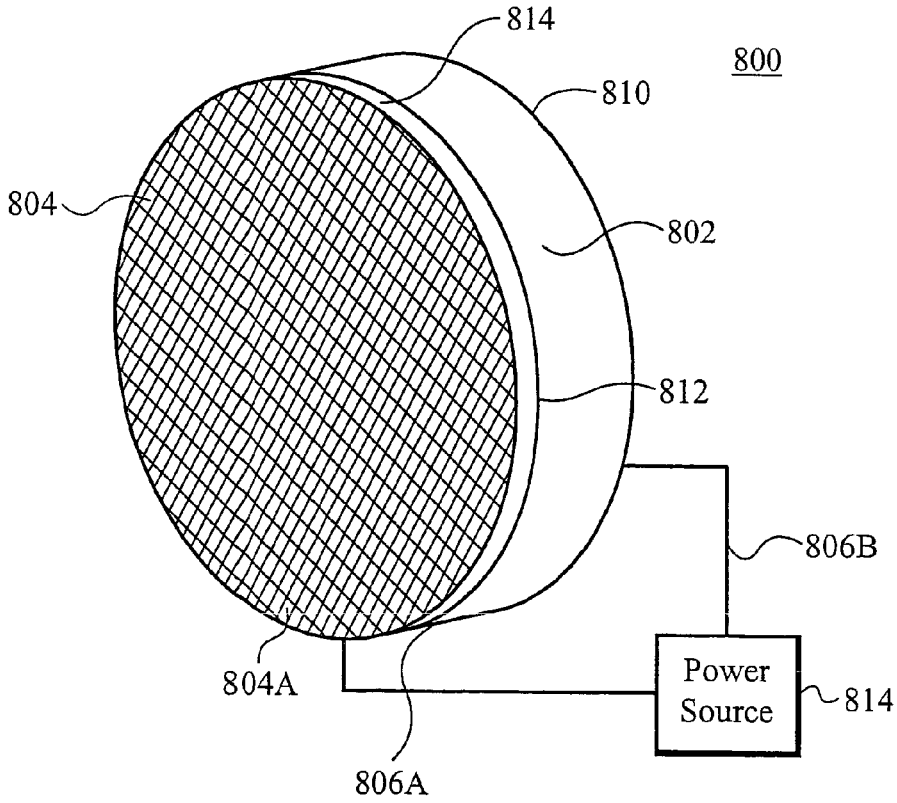
FIG. 5F illustrates a perspective view of an alternative embodiment of the pump including the applied electrode layer in accordance with the present invention.
Figure 6:
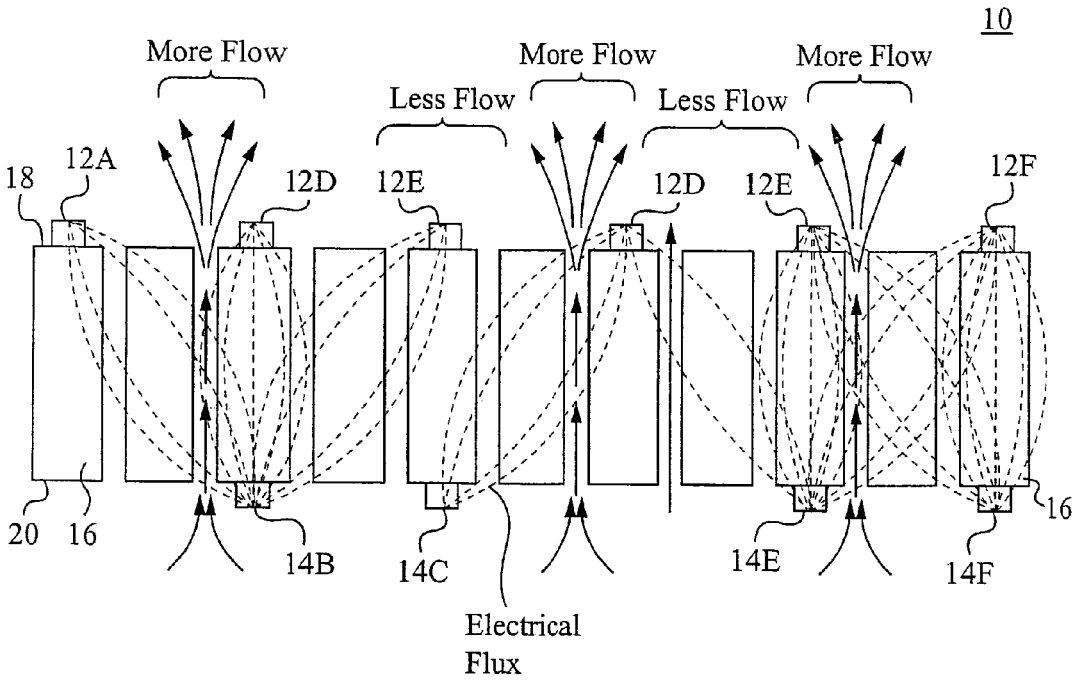
Fig. 6 (PRIOR ART)
FIG. 6 illustrates a schematic of a prior art pump having spaced apart electrodes.

It is apparent to one skilled in the art that other electrode layer configurations are contemplated in accordance with the present invention. For instance, as shown in FIG. 5F, the pump 800 includes a dense screen or wire mesh 804 coupled thereto. In particular, the screen electrode 804 is made or treated to be electrically conductive and is coupled to the top and/or bottom surface 812 of the pump body 802. In one embodiment, the screen electrode 804 is mechanically coupled to the surface 812 of the pump body 802. In another embodiment, the screen electrode 804 is coupled to the surface of the pump body 802 by an adhesive material 814. Alternatively, the screen electrode 804 is disposed on the thin film electrode (FIG. 5A). As shown in FIG. 5F, the screen electrode 804 includes several apertures within the lattice configuration of fibers, whereby the fluid flows through the apertures. In one embodiment, the individual fibers in the screen electrode 804 are separated by a distance smaller than the distance in between the top 812 and bottom surfaces 810 of the pump body 802. In another embodiment, the individual fibers in the screen electrode 804 are separated by a distance larger than or equal to the distance in between the top 812 and bottom surfaces 810 of the pump body 802.

The method of manufacturing the pump of the present invention will now be discussed. The pumping structure is formed initially by any appropriate method, as in step 200 in FIG. 7. The pump of the present invention is manufacturable several different ways. Preferably, non-parallel, complex shaped pore apertures 511 shown in FIG. 3 in the frit pump are fabricated by sintering or pressing powders into the pump element material. For example, sintered borosilicate glass disks are fabricated for industrial water filtration applications, and are suitable for this application. Other sintered powders including but not limited to Silicon Nitride, Silicon Dioxide, Silicon Carbide, ceramic materials such as Alumina, Titania, Zirconia are alternatively used. In these cases, the pores are irregular and nonuniform, but the fabrication process is extremely inexpensive. Alternatively, the pump is made by a series of lithographic/etching steps, such as those used in conventional integrated circuit manufacturing, to make parallel pore apertures (FIGS. 5A–5D) or non-parallel pore apertures 511 (FIG. 3). Details of these manufacturing steps are discussed in co-pending U.S. patent application Ser. No. 10/366,121, filed Feb. 12, 2003 and entitled, "MICRO-FABRICATED ELECTROKINETIC PUMP," which is hereby incorporated by reference.

Once the pumping element is formed by any of the above processes, the electrodes are formed onto the pump. Referring to FIGS. 5A–5D, the electrodes 510, 512 are fabricated from materials that do not electrically decompose during the operation of the pump. The electrode layers are preferably made from Platinum. Although the electrodes are made from other materials including, but not limited to, Palladium, Tungsten, Nickel, Copper, Gold, Silver, Stainless Steel, Niobium, Graphite, any appropriate adhesive materials and metals or a combination thereof. It is preferred that the cathode electrodes 512 are made from the same material as the anode electrodes 510, although it is not necessary. For instance, in some pumped fluid chemistries, the cathode electrodes and anode electrodes are made of different materials to properly support operation of the pump.

In the preferred embodiment, the electrode layer 312 is formed on the top surface 308 of the pumping element body 302 as in step 202. In addition, the electrode layer 314 is formed on the bottom surface 306 of the pumping element body 302 as in step 204. Some application methods of the electrode layer onto the pump include but are not limited to: sputtering, evaporating, screen printing, spraying, dispensing, dipping, spinning, conductive ink printing, chemical vapor deposition (CVD), plasma vapor deposition (PVD) or other patterning processes.

Figure 7:
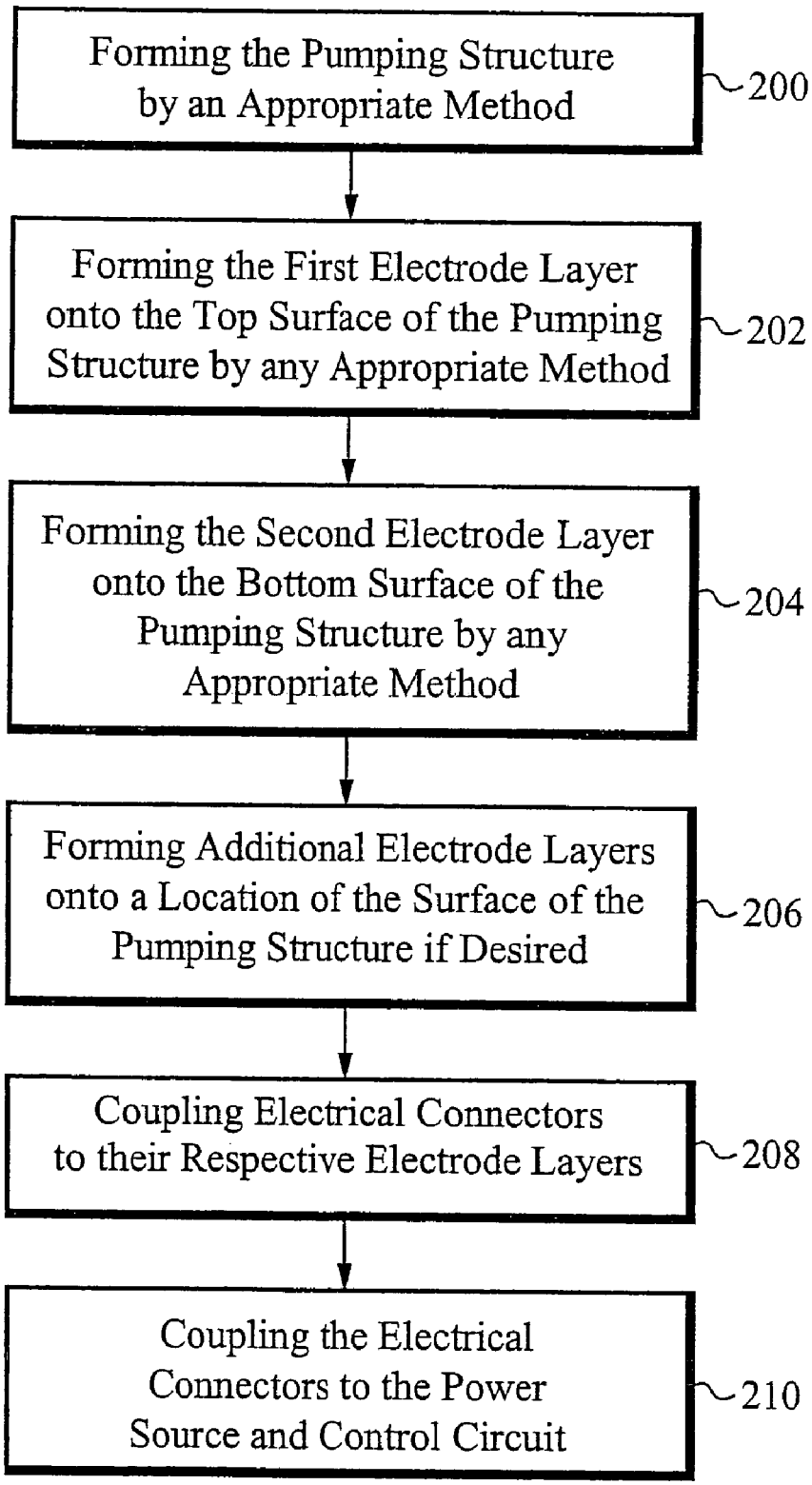
FIG. 7 illustrates a flow chart detailing a method of manufacturing the pump of the present invention.

The multi-layer electrodes described in relation to FIGS. 5B and 5C are applied to the pump by disposing additional electrode layers at desired locations on the surface or surfaces of the pumping structure as in step 206 in FIG. 7. Additional electrode layers are applied to the pump 600 by depositing metal or silver epoxy onto the thin film electrode 610, 612. Other conventional methods include, but are not limited to, using conductive ink, screen printing, patterning, shadow masking, and dipping.

In relation to FIGS. 5D and 5E, the beaded electrode layers 710, 712 are applied to the pump 700 using a variety of conventional methods, including, but not limited to, screen printing, sputtering, evaporating, dispensing, dipping, spinning, spraying or dense packing in the package. The above mentioned methods are well known in the art and are not discussed in detail herein. It should be noted that the electrodes coupled to the pumping element of the present invention are not limited to the methods described above and encompass other appropriate methods known in the art.

Relating back to FIG. 3, once the electrodes 310, 312 are formed onto the pump 300, the electrical connectors 318A, 318B are coupled to the electrodes 310, 312 respectively, as in step 208. Preferably, the electrical connectors are 318A, 318B are placed in physical contact with the electrode layers 310, 312. Alternatively, the electrical connectors 318A, 318B are coupled to the conducting surface on the fused glass portion 622 of the pump body (FIG. 5B). Following, the power source 314 is coupled to the electrode layers 310, 312, as in step 210, whereby the control circuit 320 controls the amount of current and voltage supplied to the electrode layers 310, 312.

Figure 4:
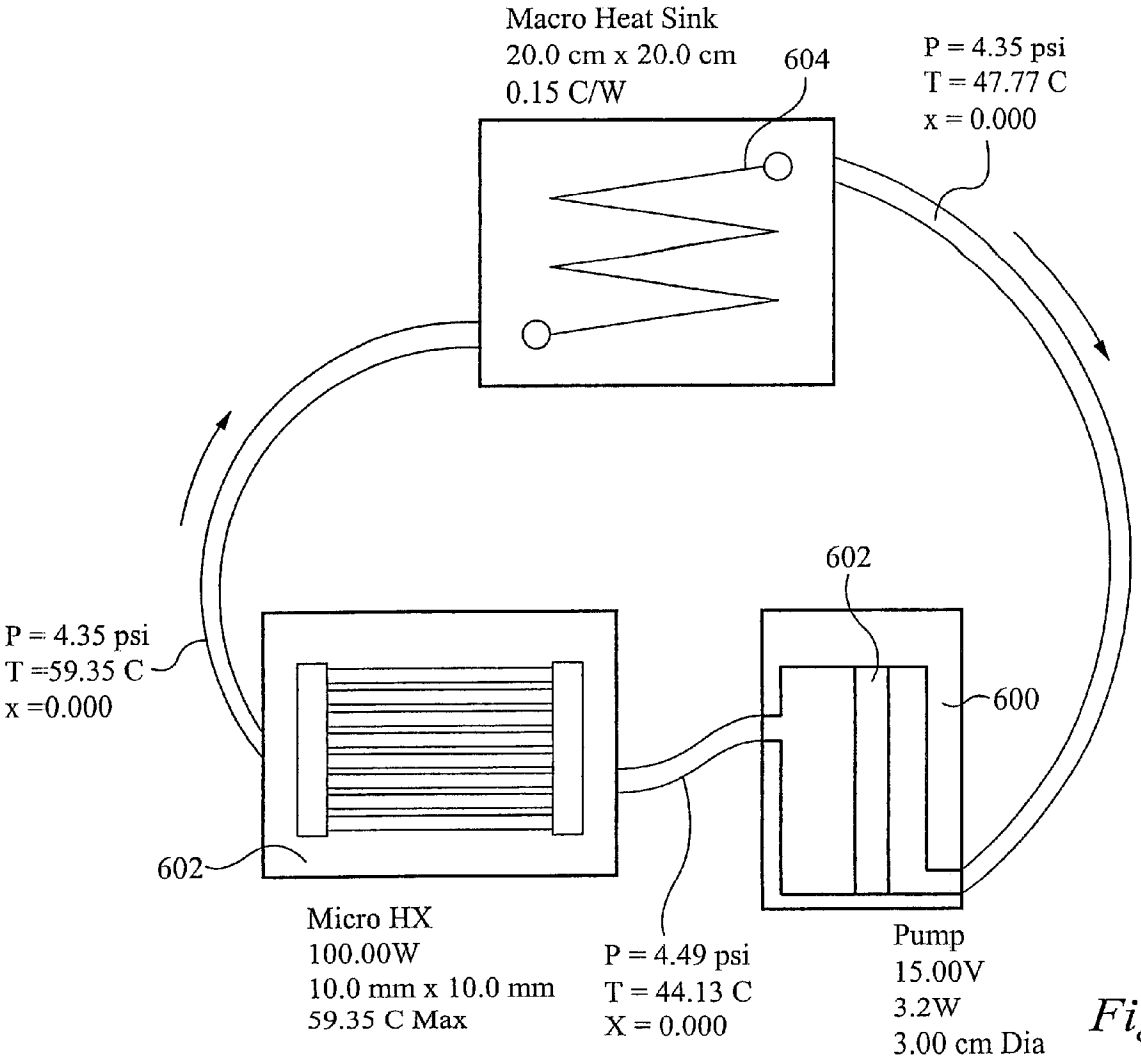
FIG. 4 illustrates a closed system loop including the pump of the present invention.

FIG. 4 illustrates a cooling system for cooling a fluid passing through a heat emitting device, such as a microprocessor. As shown in FIG. 4, the system is a closed loop whereby liquid travels to an element to be cooled, such as a microprocessor 602, whereby heat transfer occurs between the processor and the liquid. After the leaving the microprocessor 602, the liquid is at an elevated temperature of more than 55° C. and enters the heat exchanger 604, wherein the liquid is cooled to less than 45° C. The liquid then enters the pump 600 of the present invention at a lower temperature. Again, referring to FIG. 2, within the pump 100, the cooled liquid enters the support apertures 108 and is pumped through the pore apertures 110 by the osmotic process described above.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. An electroosmotic pump comprising:

a. at least one porous structure for pumping fluid therethrough and having an average pore size, the porous structure having a first side and a second side and having a first continuous layer of electrically conductive porous material having a first thickness along an axis parallel to an overall direction of fluid flow disposed on the first side, wherein the first thickness is less than the average pore size and a second continuous layer of electrically conductive porous material having a second thickness along the axis parallel to the overall direction of fluid flow disposed on the second side, wherein the second thickness is less than the average pore size, wherein at least a portion of the porous structure is configured to channel flow therethrough; and b. means for providing electrical voltage to the first layer and the second layer to produce an electrical field therebetween, wherein the means for providing is coupled to the first layer and the second layer.

2. The electroosmotic pump according to claim 1 further comprising means for generating power sufficient to pump fluid through the porous structure at a desired rate, wherein the means for generating is coupled to the means for providing.

3. The electroosmotic pump according to claim 1 wherein the porous structure includes a plurality of fluid channels extending between the first side and the second side.

4. The electroosmotic pump according to claim 1 wherein the first side and the second side are roughened.

5. The electroosmotic pump according to claim 3 wherein the plurality of fluid channels are in a straight parallel configuration.

6. The electroosmotic pump according to claim 3 wherein the plurality of fluid channels are in a non-parallel configuration.

7. The electroosmotic pump according to claim 3 wherein at least two of the plurality of fluid channels are cross connected.

8. The electroosmotic pump according to claim 1 wherein the electrically conductive porous material is disposed as a thin film electrode.

9. The electroosmotic pump according to claim 1 wherein the electrically conductive porous material is disposed as a screen mesh having an appropriate electrically conductivity.

10. The electroosmotic pump according to claim 1 wherein the electrically conductive porous material includes a plurality of conductive beads having a first diameter in contact with one another to pass electrical current.

11. The electroosmotic pump according to claim 10 wherein at least one of the plurality of beads has a second diameter larger than the first diameter.

12. The electroosmotic pump according to claim 1 wherein a predetermined portion of the continuous layer of electrically conductive porous material has a third thickness.

13. The electroosmotic pump according to claim 12 wherein the predetermined portion of the continuous layer is disposed on the surface of the porous structure in one or more desired patterns.

14. The electroosmotic pump according to claim 13 wherein at least one of the desired patterns further comprises a circular shape.

15. The electroosmotic pump according to claim 13 wherein at least one of the desired patterns further comprises a cross-hatched shape.

16. The electroosmotic pump according to claim 13 wherein at least one of the desired patterns further comprises a plurality of parallel lines.

17. The electroosmotic pump according to claim 1 wherein at least a portion of an outer region of the porous structure is made of fused non-porous glass.

18. The electroosmotic pump according to claim 1 wherein the first thickness is within the range between and including 200 Angstroms and 10,000 Angstroms.

19. The electroosmotic pump according to claim 1 wherein the second thickness is within the range between and including 200 Angstroms and 10,000 Angstroms.

20. The electroosmotic pump according to claim 1 wherein the electrically conductive porous material is Platinum.

21. The electroosmotic pump according to claim 1 wherein the electrically conductive porous material is Palladium.

22. The electroosmotic pump according to claim 1 wherein the electrically conductive porous material is Tungsten.

23. The electroosmotic pump according to claim 1 wherein the electrically conductive porous material is Copper.

24. The electroosmotic pump according to claim 1 wherein the electrically conductive porous material is Nickel.

25. The electroosmotic pump according to claim 1 further comprising an adhesion material disposed in between the electrically conductive porous material and the porous structure.

26. The electroosmotic pump according to claim 1 wherein the first layer and the second layer is made of the same electrically conductive porous material.

27. The electroosmotic pump according to claim 1 wherein the first layer and the second layer is made of different electrically conductive porous materials.

28. An electroosmotic porous structure adapted to pump fluid therethrough, the porous structure comprising a first side and a second side, the porous structure having a plurality of fluid channels therethrough, the first side having a first continuous layer of thin film electrode deposited thereon and the second side having a second continuous layer of thin film electrode deposited thereon, the first layer and the second layer coupled to a power source, wherein the power source supplies a voltage differential between the first layer and the second layer to drive fluid through the porous structure at a desired flow rate.

29. The electroosmotic porous structure according to claim 28 wherein the plurality of fluid channels extend from the first side to the second side in a straight parallel configuration.

30. The electroosmotic porous structure according to claim 28 wherein the plurality of fluid channels extend from the first side to the second side in a non-parallel configuration.

31. The electroosmotic porous structure according to claim 28 wherein at least two of the plurality of fluid channels are cross connected.

32. The electroosmotic porous structure according to claim 28 wherein the first layer of electrically conductive porous material is a screen mesh.

33. The electroosmotic porous structure according to claim 28 wherein the electrically conductive porous material further comprises a plurality of conductive beads having a first diameter in contact with one another to pass electrical current.

34. The electroosmotic porous structure according to claim 33 wherein at least one of the plurality of beads has a second diameter larger than the first diameter.

35. The electroosmotic porous structure according to claim 28 wherein a predetermined portion of the continuous layer of electrically conductive porous material has a third thickness.

36. The electroosmotic porous structure according to claim 35 wherein the predetermined portion of the continuous layer is disposed on the surface of the porous structure in one or more desired patterns.

37. The electroosmotic porous structure according to claim 28 wherein at least a portion of an outer region of the porous structure is made of fused non-porous glass.

38. The electroosmotic porous structure according to claim 28 wherein the continuous layer has a thickness within the range between and including 200 Angstroms and 10,000 Angstroms.

39. The electroosmotic porous structure according to claim 28 wherein the electrically conductive porous material is Platinum.

40. The electroosmotic porous structure according to claim 28 wherein the electrically conductive porous material is Palladium.

41. The electroosmotic porous structure according to claim 28 wherein the electrically conductive porous material is Tungsten.

42. The electroosmotic porous structure according to claim 28 wherein the electrically conductive porous material is Nickel.

43. The electroosmotic porous structure according to claim 28 wherein the electrically conductive porous material is Copper.

44. The electroosmotic porous structure according to claim 28 further comprising an adhesion material disposed in between the electrically conductive porous material and the porous structure.

45. An electroosmotic pump comprising:

a. at least one porous structure for pumping fluid therethrough, the porous structure having a first side and a second side and having a first continuous layer of electrically conductive porous material having an appropriate first thickness disposed on the first side and a second continuous layer of electrically conductive porous material having a second thickness disposed on the second side wherein at least a portion of the porous structure is configured to channel flow therethrough, and wherein the first side and the second side are roughened; and b. means for providing electrical voltage to the first layer and the second layer to produce an electrical field therebetween, wherein the means for providing is coupled to the first layer and the second layer.

46. An electroosmotic pump comprising:

a. at least one porous structure for pumping fluid therethrough, the porous structure having a first side and a second side and having a first continuous layer of electrically conductive porous material having an appropriate first thickness disposed on the first side and a second continuous layer of electrically conductive porous material having a second thickness disposed on the second side wherein at least a portion of the porous structure is configured to channel flow therethrough, and wherein the porous structure includes a plurality of fluid channels extending in a non-parallel configuration between the first side and the second side; and b. means for providing electrical voltage to the first layer and the second layer to produce an electrical field therebetween, wherein the means for providing is coupled to the first layer and the second layer.

47. An electroosmotic pump comprising:

a. at least one porous structure for pumping fluid therethrough, the porous structure having a first side and a second side and having a first continuous layer of electrically conductive porous material having an appropriate first thickness disposed on the first side and a second continuous layer of electrically conductive porous material having a second thickness disposed on the second side wherein at least a portion of the porous structure is configured to channel flow therethrough, and wherein the porous structure includes a plurality of fluid channels extending between the first side and the second side, wherein at least two of the plurality of fluid channels are cross connected; and b. means for providing electrical voltage to the first layer and the second layer to produce an electrical field therebetween, wherein the means for providing is coupled to the first layer and the second layer.

48. An electroosmotic pump, comprising:

a. a porous structure forming therein a plurality of passages coupling a first set of apertures on a first surface to a second set of apertures on a second surface, wherein at least one of the first set of apertures and the second set of apertures forms a two-dimensional pattern on its surface;

b. a first layer of electrically conductive porous material deposited on the first surface and configured so that fluid can pass through the first layer, through the first set of apertures and into the plurality of passages;

c. a second layer of electrically conductive porous material deposited on the second surface and configured so that fluid can pass from the plurality of passages through the second set of apertures and through the second layer; and d. means for providing electrical voltage to the first layer and the second layer to produce an electrical field therebetween, wherein the means for providing is coupled to the first layer and the second layer.

49. An electroosmotic porous structure adapted to pump fluid therethrough, the porous structure comprising a first side with a first set of apertures therein and a second side with a second set of apertures therein, the porous structure having a plurality of fluid channels therethrough coupling the first set of apertures to the second set of apertures, the first side having a first continuous layer of electrically conductive porous material deposited thereon so that each of the first set of apertures is surrounded by a continuous structure of electrically conductive porous material and the second side having a second continuous layer of electrically conductive porous material deposited thereon so that each of the second set of apertures is surrounded by a continuous structure of electrically conductive porous material, the first layer and the second layer coupled to a power source, wherein the power source supplies a voltage differential between the first layer and the second layer to drive fluid through the porous structure at a desired flow rate.

* * * * *

UNITED STATES PATENT AND TRADEMARK OFFICE

CERTIFICATE OF CORRECTION

PATENT NO. : 7,086,839 B2
APPLICATION NO. : 10/669495
DATED : August 8, 2006
INVENTOR(S) : Thomas W. Kenny et al.

It is certified that error appears in the above-identified patent and that said Letters Patent is hereby corrected as shown below:

On the title page item (56),
IN THE REFERENCES CITED - U.S. PATENT DOCUMENTS - p. 2 col. 2, line 7, Add --5,575,929 A 5/1996 Dusablon, Sr. et al.--

Signed and Sealed this

Twenty-first Day of November, 2006

JON W. DUDAS
*Director of the United States Patent and Trademark Office*